US010577768B2

(12) United States Patent
Kebadze et al.

(10) Patent No.: US 10,577,768 B2
(45) Date of Patent: Mar. 3, 2020

(54) SYSTEMS AND METHODS FOR TETHERING SUBSEA STRUCTURE MOUNTED ON A WELLHEAD

(71) Applicant: Trendsetter Vulcan Offshore, Inc., Houston, TX (US)

(72) Inventors: Elizbar Buba Kebadze, Sutton (GB); John D. Henderson, Bishop's Stortford (GB); James V. Maher, Houston, TX (US); Mario Lugo, Houston, TX (US); Brent Cox, Houston, TX (US)

(73) Assignee: TRENDSETTER VULCAN OFFSHORE, INC., Houston, TX (US)

( * ) Notice: Subject to any disclaimer, the term of this patent is extended or adjusted under 35 U.S.C. 154(b) by 0 days.

(21) Appl. No.: 16/266,266

(22) Filed: Feb. 4, 2019

(65) Prior Publication Data

US 2019/0194898 A1 Jun. 27, 2019

Related U.S. Application Data

(63) Continuation of application No. 15/849,982, filed on Dec. 21, 2017, now Pat. No. 10,233,606, which is a (Continued)

(51) Int. Cl.
*E02D 5/54* (2006.01)
*E21B 33/064* (2006.01)

(Continued)

(52) U.S. Cl.
CPC ..... *E02D 5/54* (2013.01); *E21B 33/035* (2013.01); *E21B 33/064* (2013.01); *E21B 41/04* (2013.01)

(58) Field of Classification Search
CPC ..... E02D 5/54; E21B 33/035; E21B 33/064; E21B 41/04

(Continued)

(56) References Cited

U.S. PATENT DOCUMENTS 3,017,934 A 1/1962 Rhodes
3,180,304 A 4/1965 Brady (Continued)

FOREIGN PATENT DOCUMENTS

EP 1318072 A2 6/2003
GB 2317153 A 3/1998

(Continued)

OTHER PUBLICATIONS

Samy Alhayari, "Innovative Developments in Suction Pile Technology," May 4-7, 1998, pp. 551-558, OTC 8836, Offshore Technology Conference, Houston, USA.

(Continued)

*Primary Examiner* — Anna M Momper
*Assistant Examiner* — Patrick F Lambe
(74) *Attorney, Agent, or Firm* — Porter Hedges LLP; Jonathan M. Pierce; Pierre H. D. Campanac

(57) ABSTRACT

A system for tethering a subsea blowout preventer (BOP) includes a plurality of anchors disposed about the subsea BOP and secured to the sea floor, a plurality of tensioning systems, and a plurality of flexible tension members. Each tensioning system is coupled to a frame of the BOP and is configured to apply a tensile preload to one of the tension members. Each tension member is coupled to one of the anchors and extends from a first end coupled to one of the tensioning systems to a second end coupled to an anchor.

22 Claims, 28 Drawing Sheets

Related U.S. Application Data continuation of application No. 15/149,825, filed on May 9, 2016, now Pat. No. 9,879,396, which is a continuation of application No. 14/313,633, filed on Jun. 24, 2014, now Pat. No. 9,359,852.

(60) Provisional application No. 61/838,709, filed on Jun. 24, 2013.

(51) Int. Cl.
*E21B 33/035* (2006.01)
*E21B 41/04* (2006.01)

(58) Field of Classification Search
USPC ..... 166/345
See application file for complete search history.

(56) References Cited

U.S. PATENT DOCUMENTS

| | | | | |
|---|---|---|---|---|
| 3,307,624 | A | 3/1967 | Lubinski | |
| 3,496,900 | A | 2/1970 | Mott et al. | |
| 4,549,702 | A * | 10/1985 | Councilman | A01K 89/0123 242/246 |
| 4,595,087 | A | 6/1986 | Morisawa et al. | |
| 4,597,350 | A | 7/1986 | Mott | |
| 4,710,061 | A | 12/1987 | Blair et al. | |
| 4,818,146 | A | 4/1989 | Fontenot | |
| 5,845,893 | A | 12/1998 | Groves | |
| 6,193,441 | B1 | 2/2001 | Fisher | |
| 7,392,757 | B2 * | 7/2008 | Niebur | B63B 21/50 114/200 |
| 8,425,156 | B2 | 4/2013 | Thomas | |
| 9,074,447 | B1 | 7/2015 | Cox | |
| 9,341,025 | B2 | 5/2016 | Labrugere | |
| 2002/0100589 | A1 * | 8/2002 | Childers | E21B 33/0355 166/339 |
| 2002/0189522 | A1 | 12/2002 | Dove et al. | |
| 2006/0042800 | A1 | 3/2006 | Millheim et al. | |
| 2006/0162933 | A1 | 7/2006 | Millheim et al. | |
| 2007/0017429 | A1 | 1/2007 | Riggs | |
| 2008/0245285 | A1 | 10/2008 | Driscoll et al. | |
| 2010/0192828 | A1 * | 8/2010 | Lenes | B63B 21/04 114/230.23 |
| 2010/0224843 | A1 | 9/2010 | Christensen et al. | |
| 2010/0294505 | A1 | 11/2010 | Sbordone et al. | |
| 2012/0297890 | A1 | 11/2012 | Dang et al. | |
| 2013/0105171 | A1 | 5/2013 | Strand | |
| 2014/0352972 | A1 | 12/2014 | Gutierrez et al. | |
| 2014/0374115 | A1 | 12/2014 | Kebadze et al. | |
| 2014/0374116 | A1 | 12/2014 | Kelso et al. | |
| 2016/0251817 | A1 | 9/2016 | Kebadze et al. | |

FOREIGN PATENT DOCUMENTS

| | | | |
|---|---|---|---|
| WO | 2008130242 | A1 | 10/2008 |
| WO | 2011074986 | A1 | 6/2011 |
| WO | 2012038729 | A1 | 3/2012 |

OTHER PUBLICATIONS

Vryhof Anchors BV, "Anchor Manual 2010: The Guide to Anchoring," 2010, 188 pages, Capelle a/d Yssel, The Netherlands.

Asgeir Kristian Dahl Lien, "Methods to Improve Subsea Wellhead Fatigue Life," Dec. 17, 2009, Faculty of Engineering and Technology, Department for Petroleum Engineering and Applied Geophysics, NYNU, Trondheim 2009.

International Search Report and Written Opinion dated Apr. 24, 2018 for corresponding WO Patent Application No. PCT/US2018/016821, 9 pages.

* cited by examiner

SYSTEMS AND METHODS FOR TETHERING SUBSEA STRUCTURE MOUNTED ON A WELLHEAD

CROSS-REFERENCE TO RELATED APPLICATIONS

This application is a continuation of U.S. patent application Ser. No. 15/849,982, which was filed on Dec. 21, 2017, and which is hereby incorporated herein by reference in its entirety. U.S. patent application Ser. No. 15/849,982 is a continuation of U.S. patent application Ser. No. 15/149,825, now U.S. Pat. No. 9,879,396, which was filed on May 9, 2016, and which is hereby incorporated herein by reference in its entirety. U.S. patent application Ser. no. 15/149,825 is a continuation of U.S. patent application Ser. No. 14/313,633, now U.S. Pat. No. 9,359,852, which was filed on Jun. 24, 2014, and which is hereby incorporated herein by reference in its entirety. U.S. patent application Ser. No. 14/313,633 claims priority benefit to U.S. provisional patent application Ser. No. 61/838,709, which was filed on Jun. 24, 2013, and which is hereby incorporated herein by reference in its entirety.

STATEMENT REGARDING FEDERALLY SPONSORED RESEARCH OR DEVELOPMENT

Not applicable.

BACKGROUND

The disclosure relates generally to systems and methods for tethering subsea structures. More particularly, the disclosure relates to systems and methods for enhancing the strength and fatigue performance of subsea blowout preventers, wellheads, and primary conductors during subsea drilling, completion, production, and workover operations.

In offshore drilling operations, a large diameter hole is drilled to a selected depth in the sea bed. Then, a primary conductor extending from the lower end of an outer wellhead housing, also referred to as a low pressure housing, is run into the borehole with the outer wellhead housing positioned just above the sea floor/mud line. To secure the primary conductor and outer wellhead housing in position, cement is pumped down the primary conductor and allowed to flow back up the annulus between the primary conductor and the borehole sidewall.

With the primary conductor cemented in place, a drill bit connected to the lower end of a drillstring suspended from a drilling vessel or rig at the sea surface is lowered through the primary conductor to drill the borehole to a second depth. Next, an inner wellhead housing, also referred to as a high pressure housing, is seated in the upper end of the outer wellhead housing. A string of casing extending downward from the lower end of the inner wellhead housing (or seated in the inner wellhead housing) is positioned within the primary conductor. Cement then is pumped down the casing string, and allowed to flow back up the annulus between the casing string and the primary conductor to secure the casing string in place.

Prior to continuing drilling operations in greater depths, a blowout preventer (BOP) is mounted to the wellhead, and a lower marine riser package (LMRP) is mounted to the BOP. The subsea BOP and LMRP are arranged one-atop-the-other. In addition, a drilling riser extends from a flex joint at the upper end of the LMRP to a drilling vessel or rig at the sea surface. The drill string is suspended from the rig through the drilling riser, LMRP, and BOP into the well bore. Drilling generally continues while successively installing concentric casing strings that line the borehole. Each casing string is cemented in place by pumping cement down the casing and allowing it to flow back up the annulus between the casing string and the borehole sidewall. During drilling operations, drilling fluid, or mud, is delivered through the drill string, and returned up an annulus between the drill string and casing that lines the well bore.

Following drilling operations, the cased well is completed (i.e., prepared for production). For subsea architectures that employ a horizontal production tree, the horizontal subsea production tree is installed on the wellhead below the BOP and LMRP during completion operations. Thus, the subsea production tree, BOP, and LMRP are arranged one-atop-the-other. Production tubing is run through the casing and suspended by a tubing hanger seated in a mating profile in the inner wellhead housing or production tree. Next, the BOP and LMRP are removed from the production tree, and the tree is connected to the subsea production architecture (e.g., production manifold, pipelines, etc.). From time to time, intervention and/or workover operations may be necessary to repair and/or stimulate the well to restore, prolong, or enhance production.

BRIEF SUMMARY OF THE DISCLOSURE

In some aspects, a system for tethering a subsea blowout preventer (BOP) may comprise an anchor disposed about the subsea BOP and secured to the sea floor, and a flexible tension member extending from a first end to a second end coupled to a tensioning system. The flexible tension member may extend horizontally and vertically from the first end to the second end to impart a lateral preload and a vertical preload to the subsea BOP. The tensioning system may include a winch configured to pay in and pay out the flexible tension member. The winch may include a base, a spool rotatably coupled to the base, and a locking mechanism coupled to the spool and the base. The locking mechanism may have a locked position preventing the spool from rotating relative to the base. The winch may be coupled to a frame of the subsea BOP and the first end of the flexible tension member is coupled to the anchor.

In some aspects, a method for tethering a subsea blowout preventer (BOP) coupled to a subsea wellhead to an anchor disposed about the subsea BOP and secured to the sea floor may comprise a step of providing a flexible tension member extending from a first end to a second end coupled to a tensioning system. The tensioning system may include a winch configured to pay in and pay out the flexible tension member. The winch may include a base, a spool rotatably coupled to the base, and a locking mechanism coupled to the spool and the base. The locking mechanism may have a locked position preventing the spool from rotating relative to the base. The method may further comprise the steps of coupling the first end of the flexible tension member to the anchor, coupling the winch to a frame of the subsea BOP, extending the flexible tension member horizontally and vertically from the first end to the second end, imparting a lateral preload and a vertical preload to the subsea BOP, and moving the locking mechanism into the locked position.

In some aspects, a system for tethering a subsea blowout preventer (BOP) may comprise a plurality of anchors disposed about the subsea BOP and secured to the sea floor, a plurality of tensioning systems, which may each be coupled to a frame of the BOP, and a plurality of flexible tension members, which may each be coupled to one of the anchors.

Each tension member may extend from a first end coupled to one of the tensioning systems to a second end coupled to an anchor. Each tensioning system may be configured to apply a tensile preload to one of the tension members.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
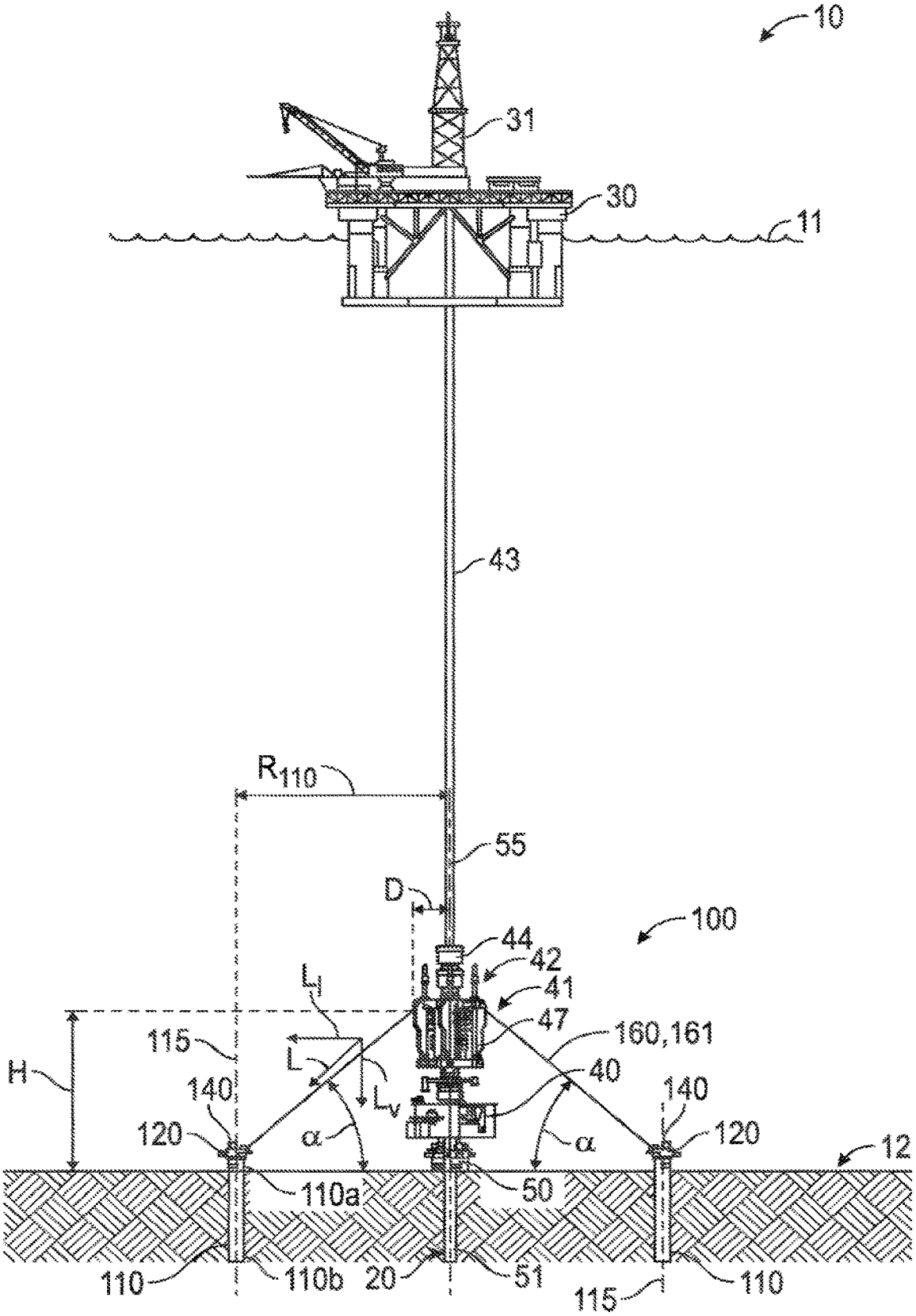
FIG. 1 is a schematic partial cross-sectional side view of an offshore system for completing a subsea well including an embodiment of a subsea tethering system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
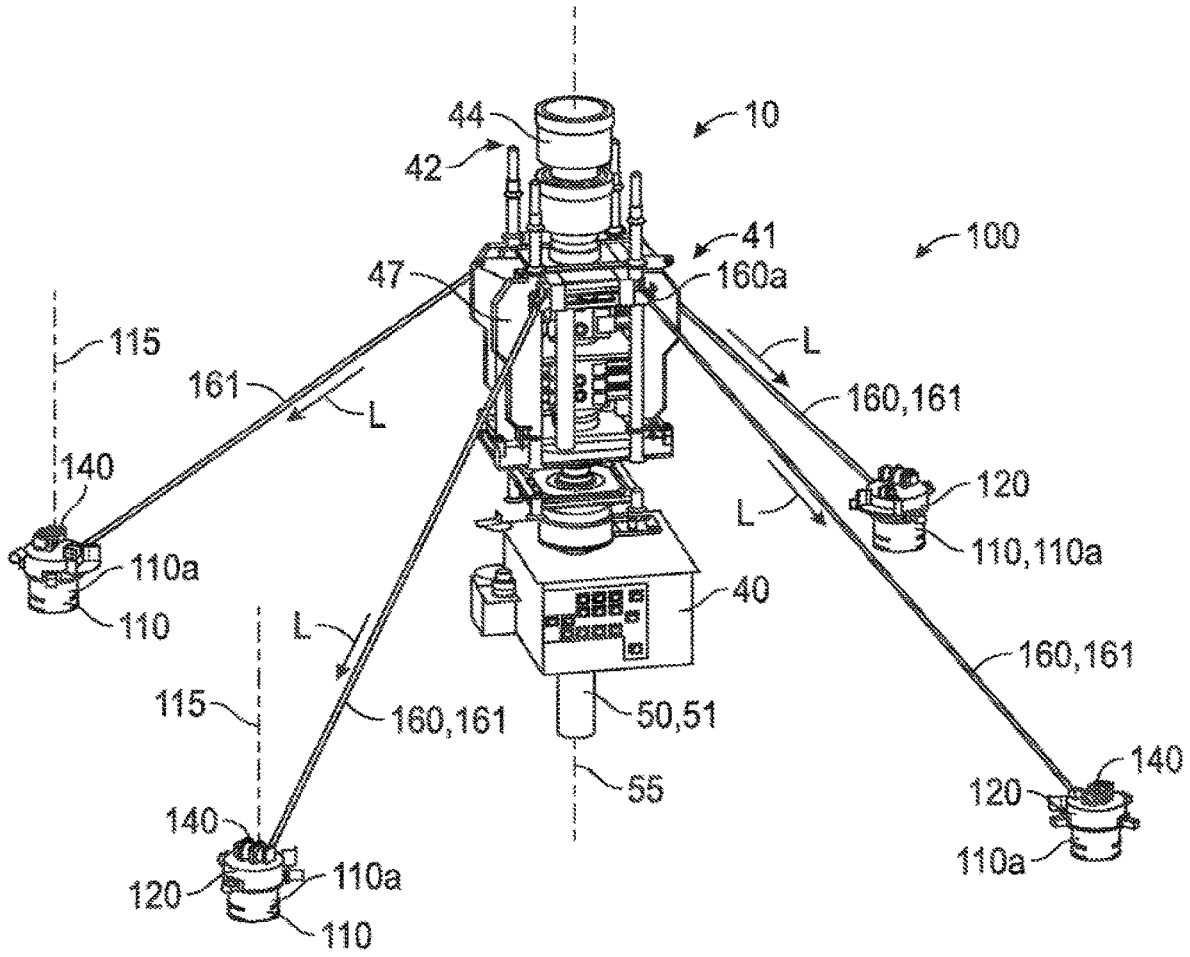
FIG. 2 is an enlarged partial isometric view of the offshore system of FIG. 1 illustrating the tethering system.

Referring now to FIGS. 1 and 2, an embodiment of an offshore system 10 for drilling and completing a wellbore 20, respectively, is shown. In this embodiment, system 10 includes a floating offshore vessel 30 at the sea surface 11, a horizontal production tree 40 releasable connected to a wellhead 50 disposed at an upper end of a primary conductor 51 extending into the wellbore 20, a subsea blowout preventer (BOP) 41 releasable connected to production tree 40, and a lower marine riser package (LMRP) 42 releasable connected to BOP 41. Tree 40, BOP 41, and LMRP 42 are vertically arranged or stacked one-above-the-other and are generally coaxially aligned with wellhead 50. Wellhead 50 has a central axis 55 and extends vertically upward from wellbore 20 above the sea floor 12. In FIG. 1, system 10 is shown configured for completion operations, and thus, includes tree 40, however, for drilling operations, tree 40 may not be included.

As best shown in FIG. 1, vessel 30 is equipped with a derrick 31 that supports a hoist (not shown). In this embodiment, vessel 30 is a semi-submersible offshore platform, however, in general, the vessel (e.g., vessel 30) can be any type of floating offshore drilling vessel including, without limitation, a moored structure (e.g., a semi-submersible platform), a dynamically positioned vessel (e.g., a drill ship), a tension leg platform, etc. A drilling riser 43 (not shown in FIG. 2) extends subsea from vessel 30 to LMRP 42. During drilling operations, riser 43 takes mud returns to vessel 30. Downhole operations are carried out by a tool connected to the lower end of the tubular string (e.g., drillstring) that is supported by derrick 31 and extends from vessel 30 through riser 43, LMRP 42, and BOP 41, and tree 40 into wellbore 20. In this embodiment, BOP 41 includes an outer rectangular prismatic frame 47.

BOP 41 and LMRP 42 are configured to controllably seal wellbore 20 and contain hydrocarbon fluids therein. Specifically, BOP 41 includes a plurality of axially stacked sets of opposed rams disposed within frame 47. In general, BOP 41 can include any number and type of rams including, without limitation, opposed double blind shear rams or blades for severing the tubular string and sealing off wellbore 20 from riser 43, opposed blind rams for sealing off wellbore 20 when no string/tubular extends through BOP 41, opposed pipe rams for engaging the string/tubular and sealing the annulus around string/tubular, or combinations thereof. LMRP 42 includes an annular blowout preventer comprising an annular elastomeric sealing element that is mechanically squeezed radially inward to seal on a string/tubular extending through LMRP 42 or seal off wellbore when no string/tubular extends through LMRP 42. The upper end of LMRP 42 includes a riser flex joint 44 that allows riser 43 to deflect and pivot angularly relative to tree 40, BOP 41, and LMRP 42 while fluids flow there through.

During drilling, completion, production, and workover operations, cyclical loads due to riser vibrations (e.g., from surface vessel motions, wave actions, current-induced VIV, or combinations thereof) are applied to BOP 41, wellhead 50, and primary conductor 51 extending from wellhead 50 into the sea floor 12. Such cyclical loads can induce fatigue. This may be of particular concern with subsea horizontal production tree architectures (e.g., system 10) due to the relatively large height and weight of the hardware secured to the wellhead proximal the mud line (i.e., tree, BOP, and LMRP). For example, in this embodiment, the hardware mounted to wellhead 50 proximal the sea floor 12, production tree 40 and BOP 41 in particular, is relatively tall, and thus, presents a relatively large surface area for interacting with environmental loads such as subsea currents. These environmental loads can also contribute to the fatigue of BOP 41, wellhead 50, and primary conductor 51. If the wellhead 50 and primary conductor 51 do not have sufficient fatigue resistance, the integrity of the subsea well may be compromised. Still further, an uncontrolled lateral movement of vessel 30 (e.g., an uncontrolled drive off or drift off of vessel 30) from the desired operating location generally over wellhead 50 can pull LMRP 42 laterally with riser 43, thereby inducing bending moments and associated stresses in BOP 41, wellhead 50, and conductor 51. Such induced bending moments and stresses can be increased further when the relatively tall and heavy combination of tree 40 and BOP 41 is in a slight angle relative to vertical. Accordingly, in this embodiment, a tethering system 100 is provided to reinforce BOP 41, wellhead 50, and primary conductor 51 by resisting lateral loads and bending moments applied thereto. As a result, system 100 offers the potential to enhance the strength and fatigue resistance of BOP 41, wellhead 50, and conductor 51.

Referring again to FIGS. 1 and 2, in this embodiment, tethering system 100 includes a plurality of anchors 110, a plurality of pile top assemblies 120, and a plurality of flexible tension members 160. One pile top assembly 120 is mounted to the upper end of each anchor 110, and one tension member 160 extends from each pile top assembly 120 to frame 47 of BOP 41. As will be described in more detail below, each pile top assembly 120 includes a tensioning system 140 that can apply tensile loads to the corresponding tension member 160. In this embodiment, each tensioning system 140 is a winch, and thus, may also be referred to as winch 140. Each winch 140 can pay in and pay out the corresponding tensioning member 160.

Each tension member 160 includes a first or distal end **160*a* coupled to frame 47 of BOP 41, and a tensioned span or portion 161 extending from the corresponding winch 140 to end 160*a*. As best shown in FIG. 1, each distal end 160*a* is coupled to frame 47 of BOP 41 at a height H measured vertically from the sea floor 12 and at a lateral distance D measured radially and horizontally from central axis 55. In this embodiment, four uniformly circumferentially-spaced anchors 110 and associated tension members 160 are provided. In addition, in this embodiment, height H of each end 160*a* is the same, lateral distances D to each end 160*a* is the same. For most subsea applications, lateral distance D is preferably between 5.0 and 15.0 feet, and more preferably about 10.0 ft. However, it should be appreciated that lateral distance D may depend, at least in part, on the available connection points to the frame 47 of BOP 41. As will be described in more detail below, each height H is preferably as high as possible but below LMRP 42, and may depend on the available connection points along frame 47 of BOP 41**.

As best shown in FIG. 1, a tensile preload L is applied to each tensioned span 161. With no external loads or moments applied to BOP 41, the actual tension in each span 161 is the same or substantially the same as the corresponding tensile preload L. However, it should be appreciated that when external loads and/or bending moments are applied to BOP 41, the actual tension in each span 161 can be greater than or less than the corresponding tensile preload L.

Winches 140 are positioned proximal to the sea floor 12, and ends **160*a* are coupled to frame 47 of BOP 41 above winches 140. Thus, each span 161 is oriented at an acute angle $\alpha$ measured upward from horizontal. Since portions 161 are in tension and oriented at acute angles $\alpha$, the tensile preload L applied to frame 47 of BOP 41 by each span 161 includes an outwardly oriented horizontal or lateral preload $L_l$ and a downwardly oriented vertical preload $L_v$. Without being limited by this or any particular theory, the lateral preload $L_l$ and the vertical preload $L_v$ applied to BOP 41 by each tension member 160 are a function of the corresponding tensile load L and the angle $\alpha$. For a given angle $\alpha$, the lateral preload $L_l$ and the vertical preload $L_v$ increase as the tensile load L increases, and decrease as the tensile load L decreases. For a given tensile load L, the lateral preload $L_l$ decreases and the vertical preload $L_v$ increases as angle $\alpha$ increases, and the lateral preload $L_l$ increases and the vertical preload $L_v$ decreases as angle $\alpha$ decreases. For example, at an angle α of 45°, the lateral preload $L_l$ and the vertical preload $L_v$ are substantially the same; at an angle α above 45°, the lateral preload $L_l$ is less than the vertical preload $L_v$; and at an angle α below 45°, the lateral preload $L_l$ is greater than the vertical preload $L_v$. In embodiments described herein, angle α of each span 161** is preferably between 10° and 60°, and more preferably between 30° and 45°.

The lateral preloads $L_l$ applied to frame 47 of BOP 41 resist external lateral loads and bending moments applied to BOP 41 (e.g., from subsea currents, riser 43, etc.). To reinforce and stabilize BOP 41, wellhead 50, and primary conductor 51 without interfering with an emergency disconnection of LMRP 42, each height H is preferably as high as possible but below LMRP 42, and may depend on the available connection points along frame 47 of BOP 41. In this embodiment, ends 160*a* are coupled to frame 47 proximal the upper end of BOP 41 and just below LMRP 42. By tethering frame 47 of BOP 41 at this location, system 100 restricts and/or prevents BOP 41, tree 40, wellhead 50, and primary conductor 51 from moving and bending laterally, thereby stabilizing such components, while simultaneously allowing LMRP 42 to be disconnected from BOP 41 (e.g., via emergency disconnect package) without any interference from system 100.

Referring again to FIGS. 1 and 2, the tensile preload L in each span 161 is preferably as low as possible but sufficient to pull out any slack, curve, and catenary in the corresponding span 161. In other words, the tensile preload in L in each span 161 is preferably the lowest tension that results in that span 161 extending linearly from the corresponding winch 140 to its end 160*a*. It should be appreciated that such tensile loads L in tension members 160 restrict and/or prevent the initial movement and flexing of BOP 41 at the onset of the application of an external loads and/or bending moments, while minimizing the tension in each span 161 before and after the application of the external loads and/or bending moments. The latter consequence minimizes the potential risk of inadvertent damage to BOP 41, tree 40, and LMRP 42 in the event one or more tension members 160 uncontrollably break.

In general, each tension member 160 can include any elongate flexible member suitable for subsea use and capable of withstanding the anticipated tensile loads (i.e., the tensile preload L as well as the tensile loads induced in spans 161 via the application of external loads to BOP 41) without deforming or elongating. Examples of suitable devices for tension members 160 can include, without limitation, chain(s), wire rope, and Dyneema® rope available from DSM Dyneema LLC of Stanley, N.C. USA. In this embodiment, each tension member 160 comprises Dyneema® rope, which is suitable for subsea use, requires the lowest tensile preload L to pull out any slack, curve, and catenary (~1.0 ton of tension), and is sufficiently strong to withstand the anticipated tensions.

Figure 4:
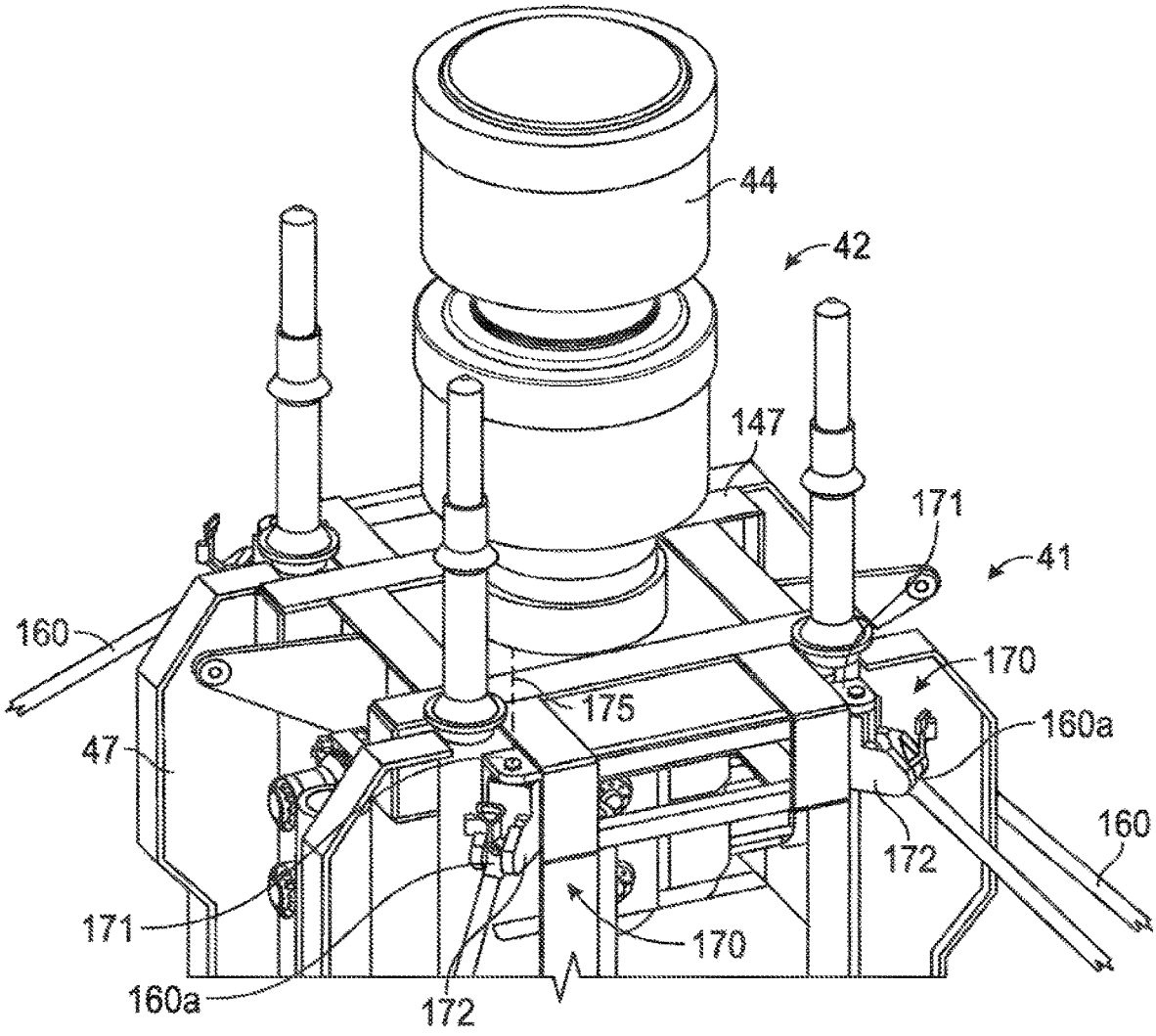
FIG. 4 is an enlarged partial isometric view of the offshore system of FIG. 2 illustrating the fairlead assemblies coupled to the BOP frame.

Referring now to FIG. 4, in this embodiment, end 160*a* of each tension member 160 is pivotally coupled to one side corner of frame 47 with a fairlead assembly 170. In general, each fairlead assembly 170 couples the corresponding tension member 160 to BOP 41 and transfers the tensile loads in the tension member 160 to BOP 41 (i.e., in the form of lateral load $L_l$ and vertical loads $L_v$), while simultaneously allowing the tension member 160 to pivot up and down about its end 160*a* (i.e., within a vertical plane) and pivot laterally (i.e., left and right) about its end 160*a*. In this embodiment, fairlead assemblies 170 are welded to the upper end of frame 47 along available space that minimizes and/or avoids interference with (a) existing or planned subsea architecture; (b) subsea operations (e.g., drilling, completion, production, workover and intervention operations); (c) wellhead 50, primary conductor 51, tree 40, BOP 41, and LMRP 42; (d) subsea remotely operated vehicle (ROV) operations and access to tree 40, BOP 41, and LMRP 42; and (e) neighboring wells.

Figure 5:
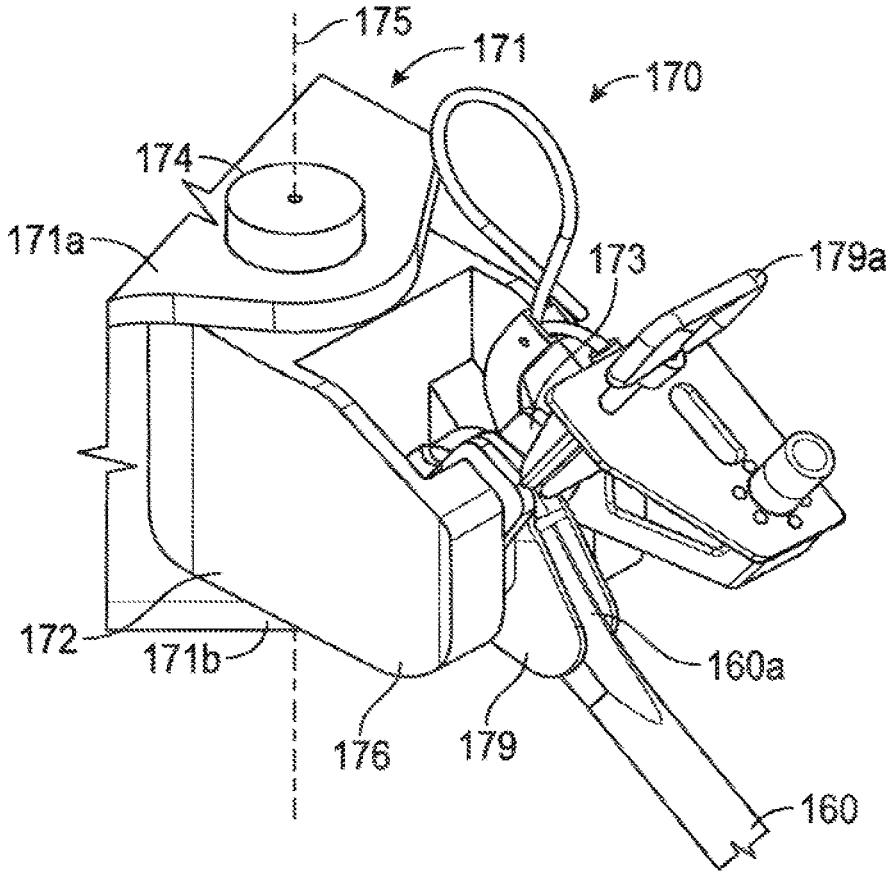
FIG. 5 is an enlarged isometric view of one of the fairlead assemblies of FIG. 4.
Figure 6:
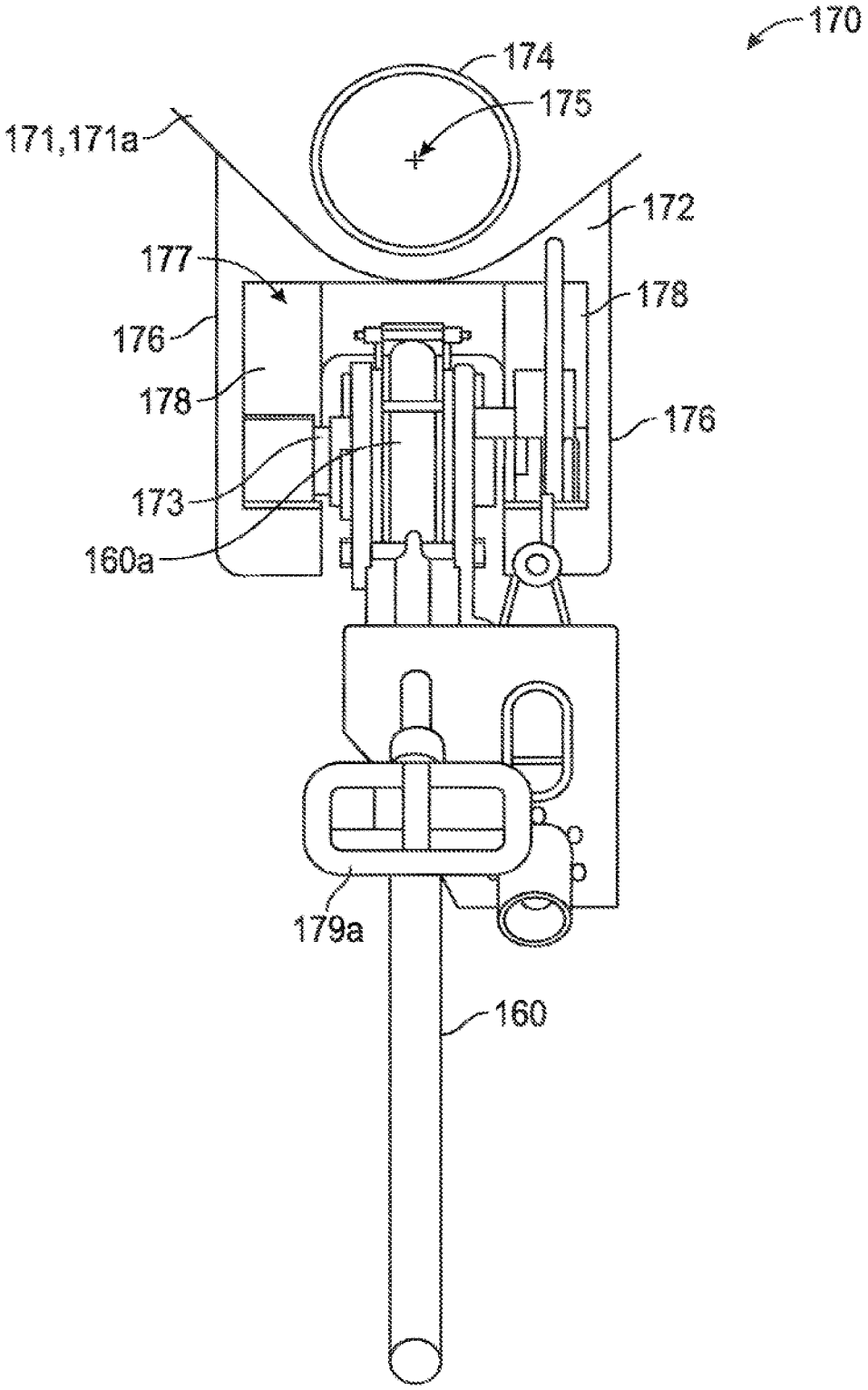
FIG. 6 is a top view of the fairlead assembly of FIG. 4.
Figure 7:
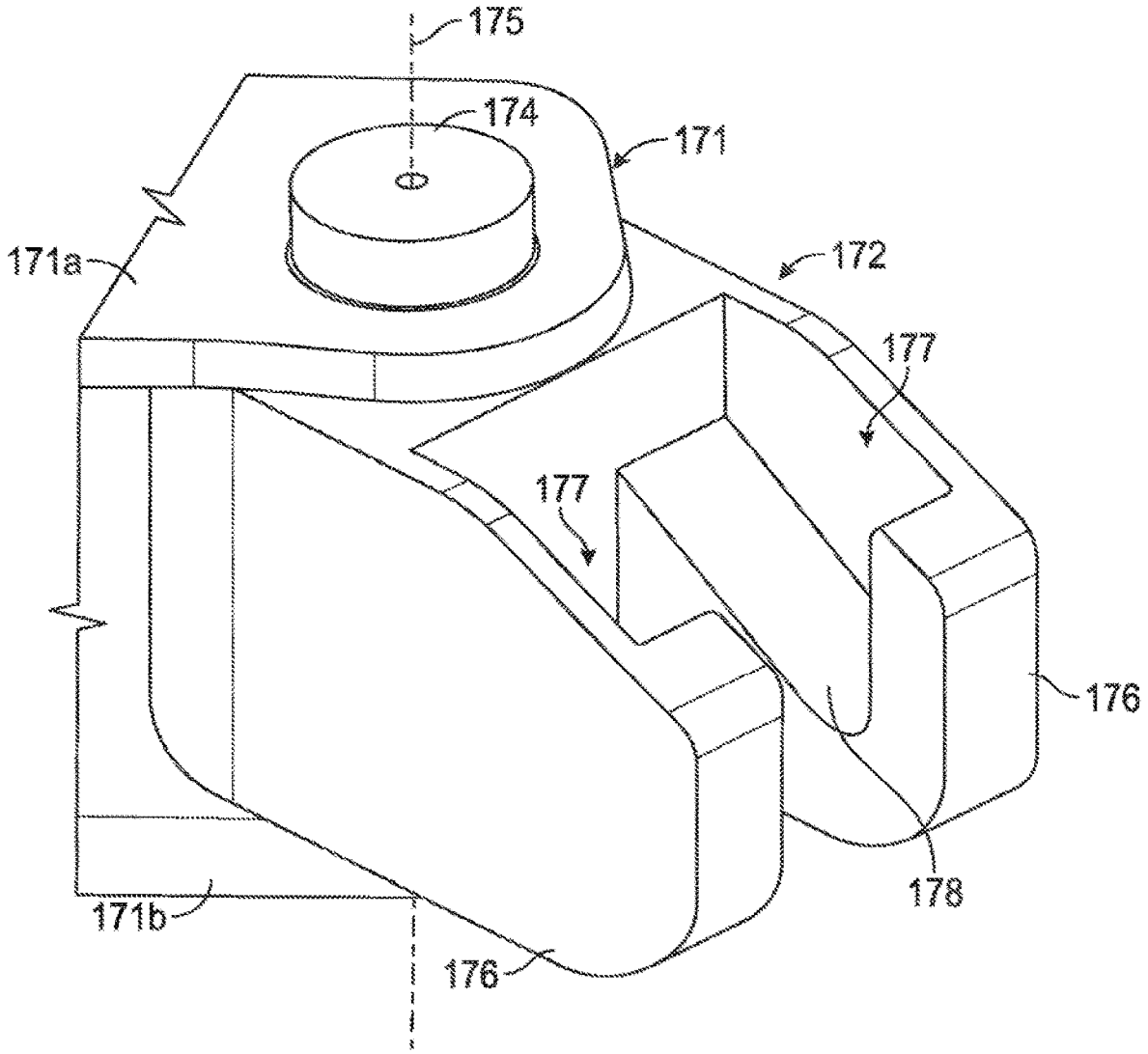
FIG. 7 is an isometric view of the base and receiver block of the fairlead assembly of FIG. 4.

Referring now to FIGS. 5-7, in this embodiment, each fairlead assembly 170 is the same and includes a base 171 attached to frame 47, a receiver block 172 pivotally coupled to base 171, and a load pin 173 removably seated in the receiver block 172. Base 171 includes a horizontal first or upper plate 171*a* extending laterally from frame 47 and a second or lower plate 171*b* extending laterally from frame 47. Receiver block 172 is slidably disposed between plates 171*a*, 171*b* and pivotally coupled to plates 171*a*, 171*b* with a vertical pin 174. As a result, receiver block 172 is free to pivot relative to base 171 and frame 47 about the vertically oriented central axis 175 of pin 174. As best shown in FIG. 7, receiver block 172 includes a pair of horizontally spaced arms 176. The opposed inner surfaces of each arm 176 include receptacles or pockets 177 extending downward from the top of the corresponding arm 176 to a concave shoulder 178.

Referring now to FIGS. 5 and 6, a thimble 179 is disposed in end 160*a* of tension member 160. Load pin 173 is passed through thimble 179 and seated in pockets 177. In particular, the ends of load pin 173 are slidably seated against concave shoulders 178. Each load pin 173 continuously measures the tension in the corresponding tension member 160. The measured tensions are communicated to the surface in near real time (or on a period basis). In general, the measured tensions can be communicated by any means known in the art including, without limitation, wired communications and wireless communications (e.g., acoustic telemetry). By way of example, in this embodiment, the tensions measured by load pins 173 are communicated acoustically to the surface (e.g., by a preexisting acoustic communication system housed on BOP 41). Communication of the measured tension in each tension member 160 to the surface enables operators and other personnel at the surface (or other remote location) to monitor the tensions, quantify the external loads on BOP 41, and identify any broken tension member(s) 160. In this embodiment, an ROV handle 179*a* is coupled to each load pin 173 to facilitate the subsea positioning of each load pin 173 in the corresponding receiver block 172. In general, each load pin 173 can comprise any suitable tensile load measuring pin known in the art.

As previously described, fairlead assemblies 170 are attached to frame 47 by welding bases 171 thereto. However, in other embodiments, the fairlead assemblies (e.g., fairlead assemblies 170) can be bolted to a suitable location of frame 47. Further, although system 100 includes one fairlead assembly 170 disposed at or proximal each of the four side corners of frame 47, in other embodiments, the fairlead assemblies (e.g., fairlead assemblies 170) can be coupled to other suitable locations along frame 47. As previously described, regardless of the means for coupling the fairlead assemblies 170 to frame 47, the fairlead assemblies 170 are preferably positioned along frame 47 to minimize and/or avoid interference with (a) existing or planned subsea architecture; (b) subsea operations (e.g., drilling, completion, production, workover and intervention operations); (c) wellhead 50, primary conductor 51, tree 40, BOP 41, and LMRP 42; (d) subsea remotely operated vehicle (ROV) operations and access to tree 40, BOP 41, and LMRP 42; and (e) neighboring wells.

In the embodiment shown in FIGS. 2 and 4, ends 160*a* of tension members 160 are pivotally coupled to frame 47 of BOP 41 with fairlead assemblies 170. However, in general, the tension members (e.g., tension members 160) can be coupled to the BOP by other suitable means. For example, in other embodiments, the fairlead assemblies 170 are eliminated, and the distal ends of the tension members (e.g., ends 160*a*) are directly coupled to the frame 47 (e.g., coupled to pad eyes attached to the BOP with shackle assemblies). Regardless of the means for coupling the tension members to the BOP, a load pin or load cell (e.g., load pin 173) is preferably provided for each tension member to measure the tension in the corresponding tension member, which is communicated to the surface.

Figure 3:
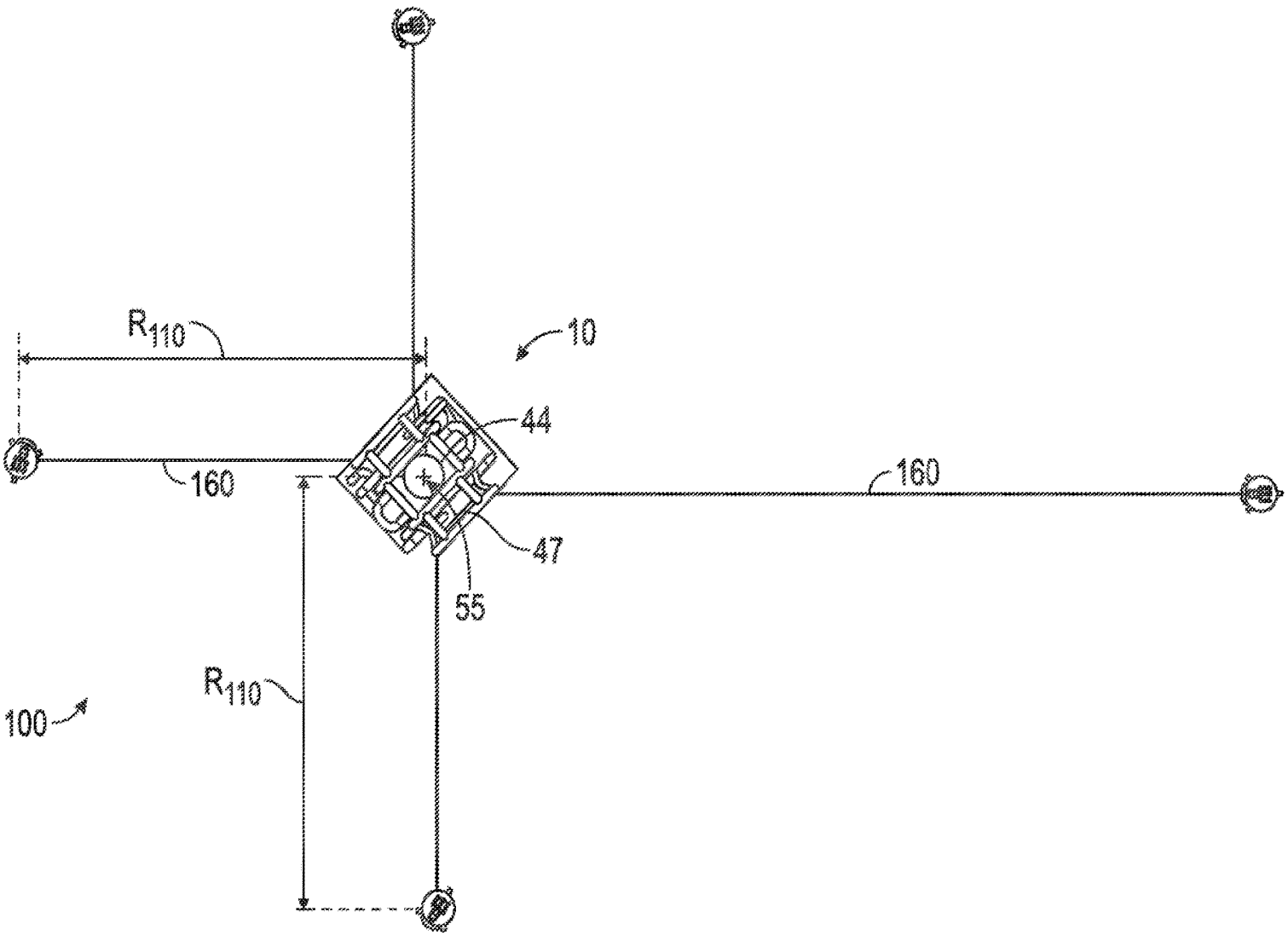
FIG. 3 is a top view of the offshore system of FIG. 2.

Referring now to FIGS. 1-3, anchors 110 are circumferentially-spaced about wellhead 50 and secured to the sea floor 12. In this embodiment, four anchors 110 are uniformly circumferentially-spaced about wellhead 50. However, in general, three or more uniformly circumferentially-spaced anchors 110 are preferably provided. The circumferential positions of anchors 110 are selected to avoid and/or minimize interference with (a) existing or planned subsea architecture; (b) subsea operations (e.g., drilling, completion, production, workover and intervention operations); (c) wellhead 50, primary conductor 51, tree 40, BOP 41, and LMRP 42; (d) subsea remotely operated vehicle (ROV) operations and access to tree 40, BOP 41, and LMRP 42; and (e) neighboring wells. In addition, as best shown in FIGS. 1 and 3, each anchor 110 is disposed at a distance $R_{110}$ measured radially and horizontally (center-to-center) from wellhead 50. Angles a are a function of distances $R_{110}$ and heights H. Thus, by varying distances $R_{110}$ and heights H, angles $\alpha$ can be adjusted as desired. However, if each height H is predetermined (e.g., ends 160*a* are coupled to frame 47 of BOP 41 at the same predetermined location such as the upper end of frame 47 of BOP 41 below LMRP 42), angles $\alpha$ are effectively a function of distances $R_{110}$. Thus, in embodiments where each height H is predetermined or known, distances $R_{110}$ are generally selected to achieve the preferred angles $\alpha$. In this embodiment, each height H is the same, however, as best shown in FIG. 3, three of the distances $R_{110}$ are the same, and the fourth distance $R_{110}$ is greater than the other three distances $R_{110}$. Consequently, three angles $\alpha$ are the same, but the fourth angle $\alpha$ is different. The lateral preloads $L_l$ applied to BOP 41 are preferably balanced and uniformly distributed. Thus, if heights H, angles $\alpha$, or distances $R_{110}$ vary among the different tension members 160, the tensile preloads L applied to tension members 160 may need to be adjusted and varied to achieve balanced and uniformly distributed lateral preloads Referring now to FIGS. 1, 2, 8, and 9, each anchor 110 is an elongate rigid member fixably disposed in the seabed. In particular, each anchor 110 has a vertically oriented central or longitudinal axis 115, an upper end 110*a* disposed above the sea floor 12, a lower end 110*b* disposed in the seabed below the sea floor 12, a cylindrical outer surface 111 extending axially between ends 110*a*, 110*b*, and an annular lip or flange 112 (FIG. 9) extending radially outward from outer surface 111 proximal upper end 110*a*. In this embodiment, each anchor 110 is a subsea pile, and thus, anchors 110 may also be referred to as piles 110. Each pile 110 is embedded in the seabed and, in general, can be any suitable type of pile including, without limitation, a driven pile or suction pile. Typically, the type of pile employed will depend on a variety of factors including, without limitation, the soil conditions at the installation site. Piles 110 are sized to penetrate the seabed to a depth to sufficiently resist the anticipated tensile loads applied to tension members 160 (i.e., the anticipated tensile preloads L plus any additional tensile loads resulting from the loads and bending moments applied to BOP 41) without moving laterally or vertically relative to the sea floor 12.

Figure 8:
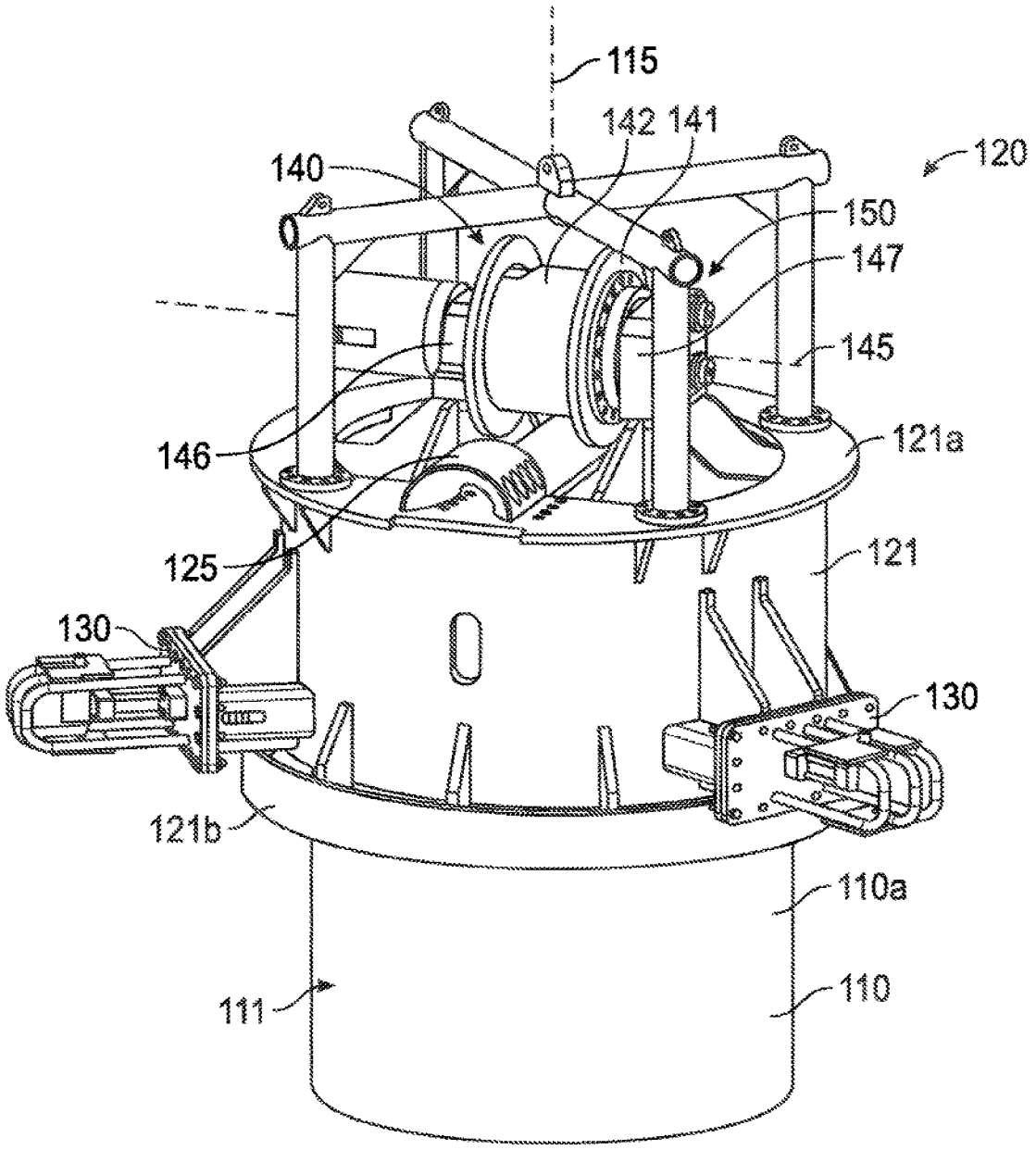
FIG. 8 is an enlarged isometric view of one of the pile top assemblies of FIG. 2.
Figure 9:
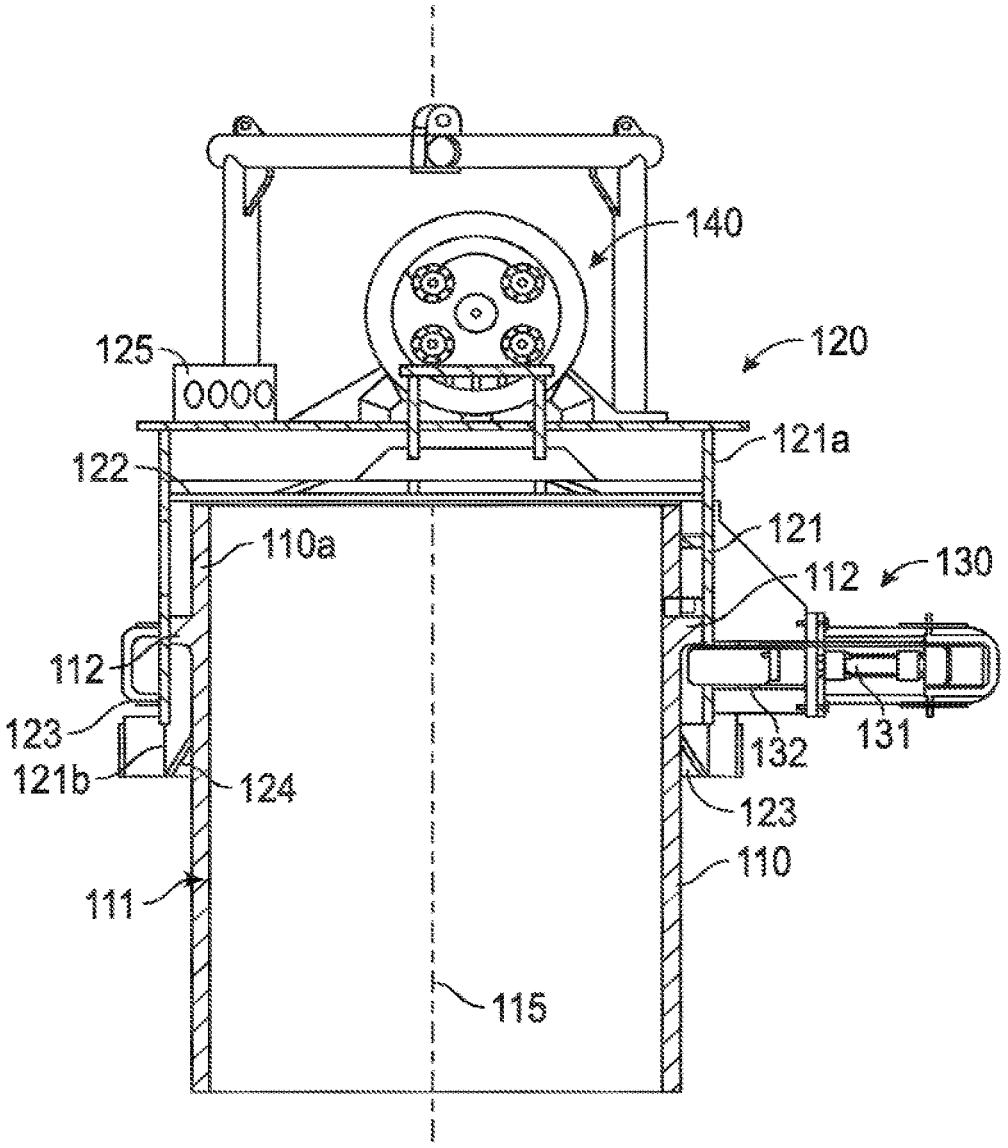
FIG. 9 is a cross-sectional side view of the pile top assembly of FIG. 8.

Referring now to FIGS. 8 and 9, one pile top assembly 120 is releasable mounted to the upper end 110*a* of one anchor 110. In this embodiment, each pile top assembly 120 is the same, and thus, one pile top assembly 120 will be described it being understood that the other pile top assemblies 120 are the same. Pile top assembly 120 includes an adapter 121 removably mounted to the upper end 110*a* of pile 110, a plurality of uniformly circumferentially-spaced locking rams 130 attached to adapter 121, and winch 140 fixably secured to adapter 121.

Adapter 121 is a generally cylindrical sleeve having a first or upper end 121*a*, a second or lower end 121*b*, a radially inner annular shoulder 122, and a receptacle 123 extending axially from lower end 121*b* to shoulder 122. Receptacle 123 is sized and configured to receive upper end 110*a* of anchor 110. To facilitate the receipt of anchor 110 and coaxial alignment of anchor 110 and adapter 121, an annular funnel or guide 125 is disposed at lower end 121*b*. Adapter 121 is generally coaxially aligned with anchor 110, and then lowered onto upper end 110*a* of anchor 110. Upper end 110*a* is advanced through lower end 121*b* and receptacle 123 until end 110*a* axially abuts shoulder 122. With end 110*a* of anchor 110 sufficiently seated in receptacle 123, it is releasable locked therein with locking rams 130 described in more detail below. A guide 125 for tension member 160 is secured to upper end 121*a*. Tensioning member 160 extends from winch 140 through annular funnel or guide 125 to end 160*a*. Thus, guide 125 generally directs tension member 160 as it is paid in and paid out from winch 140.

As best shown in FIG. 9, locking rams 130 are actuated to engage and disengage upper end 110*a* of pile 110, which is coaxially disposed in receptacle 123, and releasable lock pile top assembly 120 to pile 110. Each ram 130 includes a double-acting linear actuator 131 mounted to adapter 121 between ends 121*a*, 121*b* and a gripping member or ram block 132 coupled to the actuator 131. Each gripping member 132 is mounted to the radially inner end of the corresponding actuator 131 and extends into receptacle 123. Actuators 131 are actuated to move gripping members 132 radially inward into engagement with outer surface 111 of pile 110 and radially outward out of engagement with pile 110. Locking rams 130 are axially positioned along adapter 121 such that when actuators 131 are operated to move gripping members 132 into engagement with outer surface 111, each gripping member 132 is axially disposed immediately below annular lip 112. Thus, when gripping members 132 are moved into engagement with outer surface 111 of pile 110, friction between gripping members 132 and outer surface 111 and axial engagement of gripping members 132 with lip 112 prevent adapter 121 from being removed from pile 110. In this embodiment, each actuator 131 is an ROV operated hydraulic piston-cylinder assembly.

Figure 10:
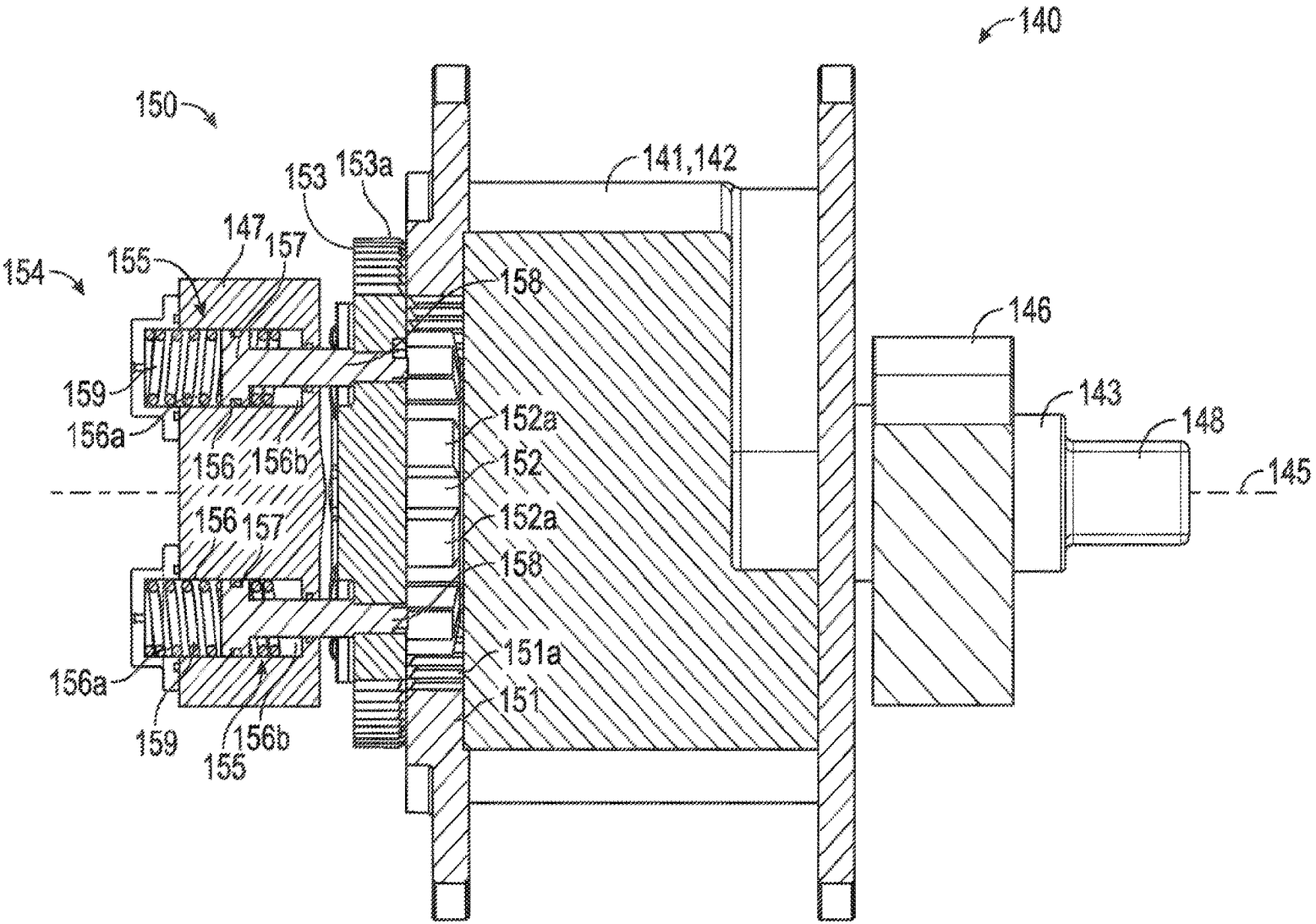
FIG. 10 is a cross-sectional view of the winch of FIG. 8 illustrating the locking mechanism.
Figure 11:
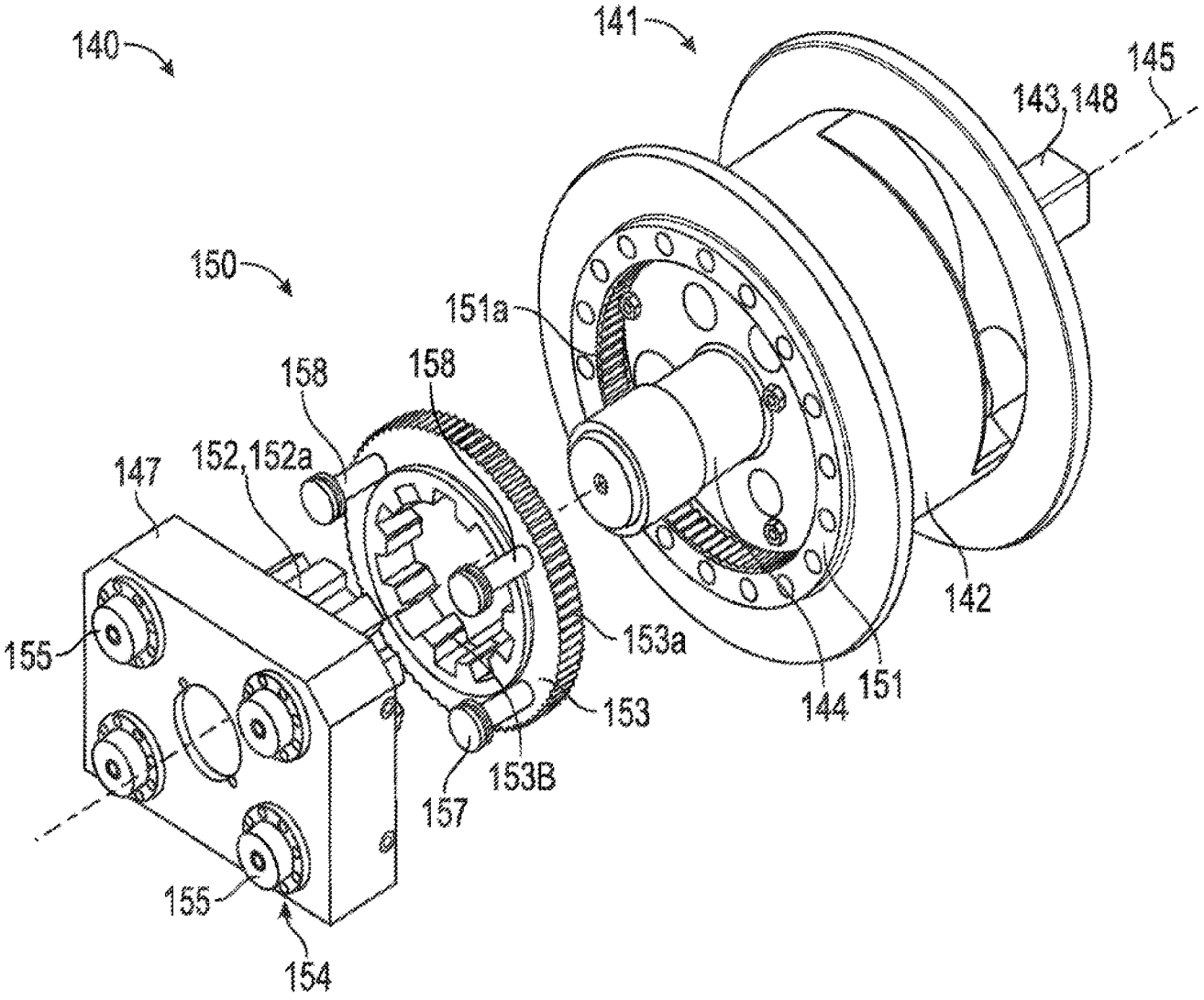
FIG. 11 is a partial exploded view of the winch of FIG. 8 illustrating the locking mechanism.

Referring now to FIGS. 8, 10 and 11, winch 140 is fixably mounted to upper end 121*a* of adapter 121. In this embodiment, winch 140 includes a spool 141 rotatably coupled to adapter 121 and a locking mechanism or brake 150 coupled to spool 141 and adapter 121. Spool 141 is selectively rotated relative to adapter 121 to pay in and pay out tension member 160. As will be described in more detail below, locking mechanism 150 releasable locks spool 141 relative to adapter 121.

Spool 141 has a horizontal axis of rotation 145 and includes a drum 142 around which tension member 160 is wound, a driveshaft 143 extending from one side of drum 142, and a support shaft 144 extending from the opposite side of drum 142. Drum 142 and shafts 143, 144 are coaxially aligned with axis 145. Driveshaft 143 extends through a connection block 146 fixably mounted to upper end 121*a* of adapter 121 and support shaft 144 extends into a connection block 147 fixably mounted to upper end 121*a* of adapter 121. Each shaft 143, 144 is rotatably supported within block 146, 147, respectively, with an annular bearing. The distal end of driveshaft 143 comprises a torque tool interface 148 designed to mate with a subsea ROV torque tool.

As best shown in FIGS. 10-13, locking mechanism 150 includes an annular spool ring 151 disposed about shaft 144 and coupled to drum 142, a hub 152 extending from block 147 and disposed about shaft 144, an annular lock ring 153 slidably mounted to hub 152, and an actuation system 154 that moves lock ring 153 axially along hub 152 into and out of spool ring 151. Spool ring 151, hub 152, and lock ring 153 are coaxially aligned with axis 145. Spool ring 151 is fixably mounted to drum 142, and hub 152 is integral with connection block 147. Spool ring 151 includes a plurality of internal splines 151*a*, hub 152 includes a plurality of external splines 152*a*, and lock ring 153 includes a plurality of external splines 153*a* and a plurality of internal splines 153*b*. Splines 151*a*, 152*a*, 153*a*, 153*b* are all oriented parallel to axis 145.

Figure 12:
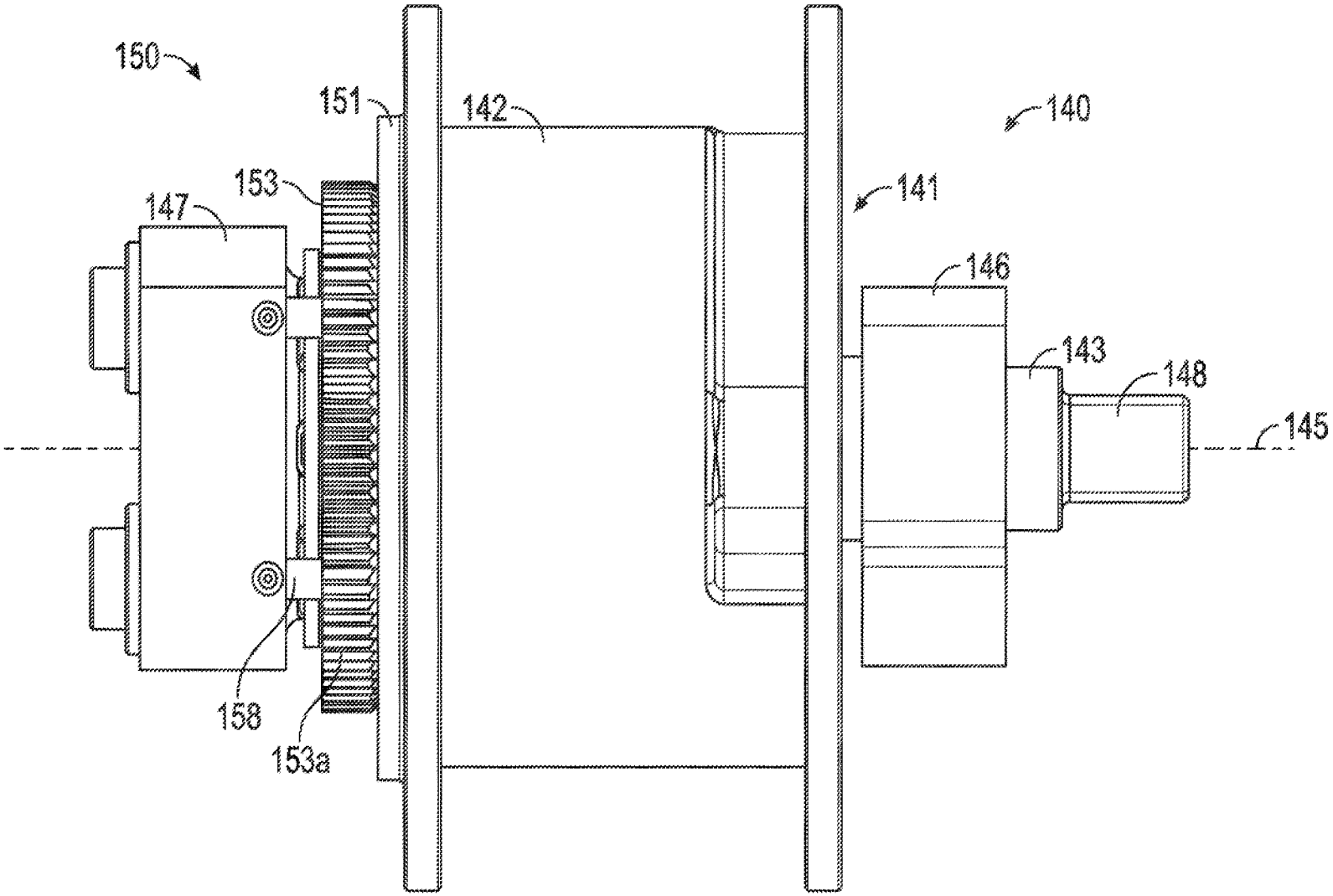
FIG. 12 is a side view of the winch of FIG. 8 with the locking mechanism and locking ring in the "unlocked" position.
Figure 13:
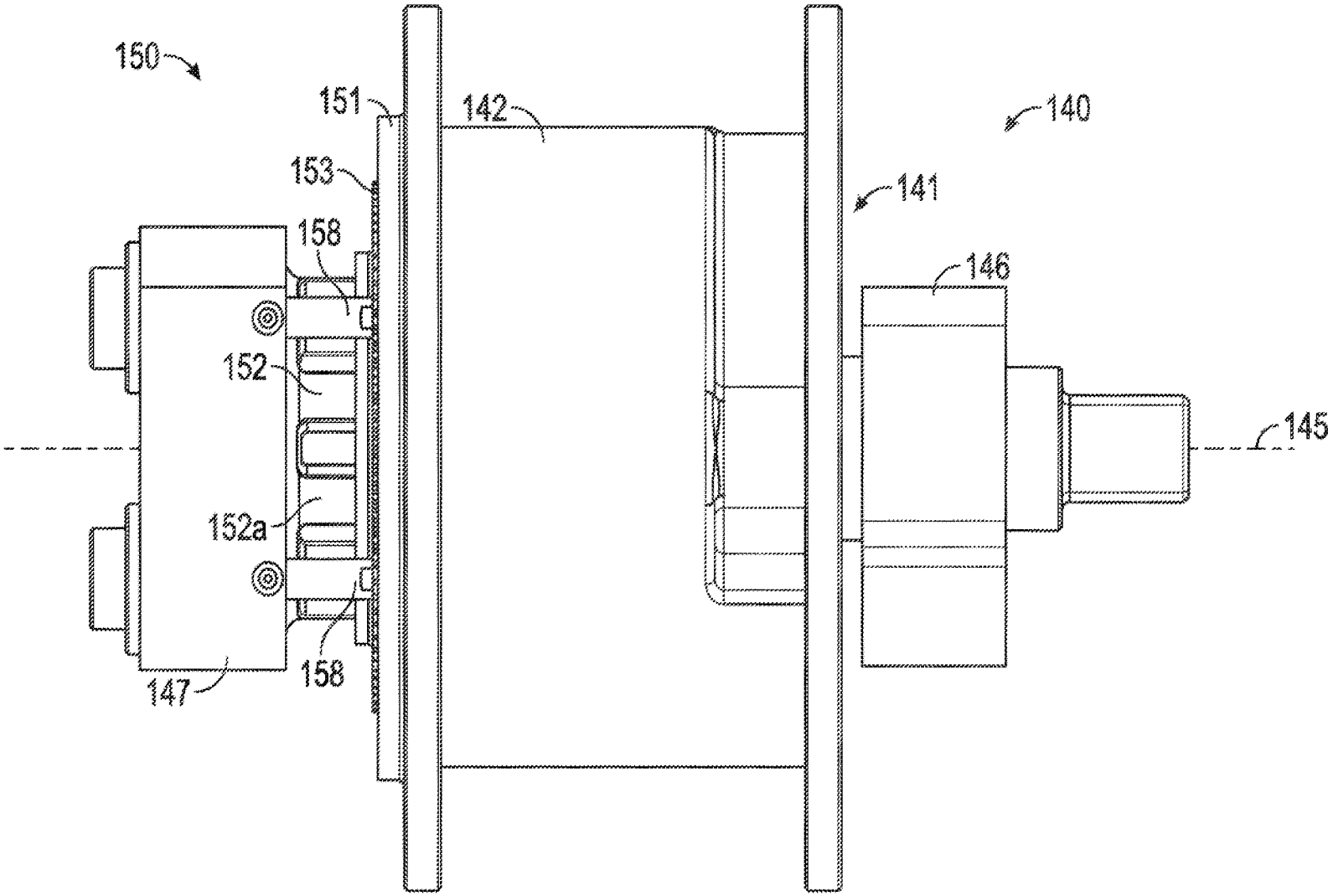
FIG. 13 is a side view of the winch of FIG. 8 with the locking mechanism and locking ring in the "locked" position.

Internal splines 151*a* of spool ring 151 and external splines 153*a* of lock ring 153 are sized and configured to mate, intermesh, and slidingly engage; and external splines 152*a* of hub 152 and internal splines 153*b* of lock ring 153 are sized and configured to mate, intermesh, and slidingly engage. Lock ring 153 is slidingly mounted to hub 152 with mating splines 152*a*, 153*b* intermeshing, and thus, lock ring 153 can move axially along hub 152 but engagement of splines 152*a*, 153*b* prevents lock ring 153 from rotating relative to hub 152. As previously described, actuation system 154 moves lock ring 153 along hub 152 into and out of spool ring 151. More specifically, as best shown in FIG. 12, when lock ring 153 is positioned outside of spool ring 151, splines 151*a*, 153*a* are axially spaced apart and drum 142 is free to rotate relative to lock ring 153, hub 152, and adapter 121. However, as best shown in FIG. 13, when lock ring 153 is positioned inside spool ring 151, mating splines 151*a*, 153*a* intermesh, thereby preventing drum 142 from rotate relative to lock ring 153. Since engagement of splines 152*a*, 153*b* prevents lock ring 153 from rotating relative to hub 152, the engagement of splines 151*a*, 153*a* also prevents drum 142 from rotating relative to hub 152 and adapter 121. Accordingly, locking mechanism 150 and lock ring 153 may be described as having an "unlocked" position (FIG. 12) with lock ring 153 positioned outside of spool ring 151, thereby allowing drum 142 to rotate freely relative to lock ring 153, hub 152, and adapter 121; and a "locked" position (FIG. 13) with lock ring 153 positioned inside of spool ring 151, thereby preventing drum 142 from rotating relative to lock ring 153, hub 152, and adapter 121.

Referring now to FIG. 11, mating splines 152*a*, 153*b* have greater circumferential widths than mating splines 151*a*, 153*a*. Without being limited by this or any particular theory, the greater the circumferential width of a spline, the greater the torque that can be transferred by that spline. Thus, splines 152*a*, 153*b* having a relatively large circumferential widths can transfer relatively large torques. Splines 151*a*, 153*b* have relatively smaller circumferential widths, but enable enhanced mating resolution. In particular, the relatively smaller splines 151*a*, 153*b* enable alignment of splines 151*a*, 153*b*, as is necessary for insertion of lock ring 153 into spool ring 151, via rotation of spool ring 151 relative to lock ring 153 through a relatively small angle. This enables relatively fine adjustment of the tensile preload L applied to tension member 160.

Referring now to FIGS. 10 and 11, actuation system 154 transitions lock ring 153 and locking mechanism 150 between the locked and unlocked positions. In this embodiment, actuation system 154 includes a plurality of double-acting linear actuators 155 coupled to lock ring 153. Actuators 155 are uniformly circumferentially-spaced about axis 145. In addition, each actuator 155 is the same, and thus, one actuator 155 will be described it being understood the other actuators 155 are the same. As best shown in FIG. 10, in this embodiment, each actuator 155 is an ROV operated hydraulic piston-cylinder assembly including a cylinder 156 disposed in block 147, a piston 157 slidably disposed in cylinder 156, an extension rod 158 coupling piston 157 to lock ring 153, and a biasing member 159 disposed in cylinder 156.

Piston 157 divides cylinder 156 into two chambers 156*a*, 156*b*. Chamber 156*a* is vented to the external environment. Biasing member 159 biases piston 157 toward spool ring 151 (to the right in FIG. 10), thereby biasing lock ring 153 and locking mechanism 150 to the locked position. However, by applying sufficient hydraulic pressure to chamber 156*b*, the biasing force of biasing member 159 is overcome, and piston 157 is moved away from spool ring 151 (to the left in FIG. 10), thereby transitioning lock ring 153 and locking mechanism 150 to the unlocked position. In this embodiment, biasing member 159 is a coil spring.

Referring now to FIGS. 2 and 8, the tensile preload L is applied to tension member 160 by transitioning lock ring 153 and locking mechanism 150 to the unlocked position via operation of actuation system 154 with a subsea ROV, and then rotating spool 141 about axis 145 with an ROV operated torque tool engaging interface 148 to pay in tension member 160. The tension member 160 and/or tension measured with the corresponding load pin 173 can be monitored until the desired tensile preload L is applied (i.e., the slack, curve, and catenary in tension member 160 are removed). Once the desired tensile preload L is achieved, locking mechanism 150 and lock ring 153 are allowed to transition back to the locked position via biasing members 159. Winch 140, and more specifically locking mechanism 150, has a sufficiently high holding capacity (e.g., on the order of hundreds of tons) to prevent the inadvertent pay out of tension member 160 when locking mechanism 150 is locked and external loads are applied to BOP 41.

Although winches 140 are coupled to anchors 110 in this embodiment, in other embodiments, the tensioning systems (e.g., winches 140) are coupled to the frame of BOP (e.g., frame 47 of BOP 41) and an end of each tension member (e.g., end 160*a* of each tension member 160) is coupled to the anchor (e.g., anchor 110). The arrangement with winches 140 coupled to anchors 110 is generally preferred as it generally requires less interaction with BOP 41 and a lower likelihood of interference with the BOP 41 (including frame 47), other subsea equipment, and subsea operations.

Figure 14:
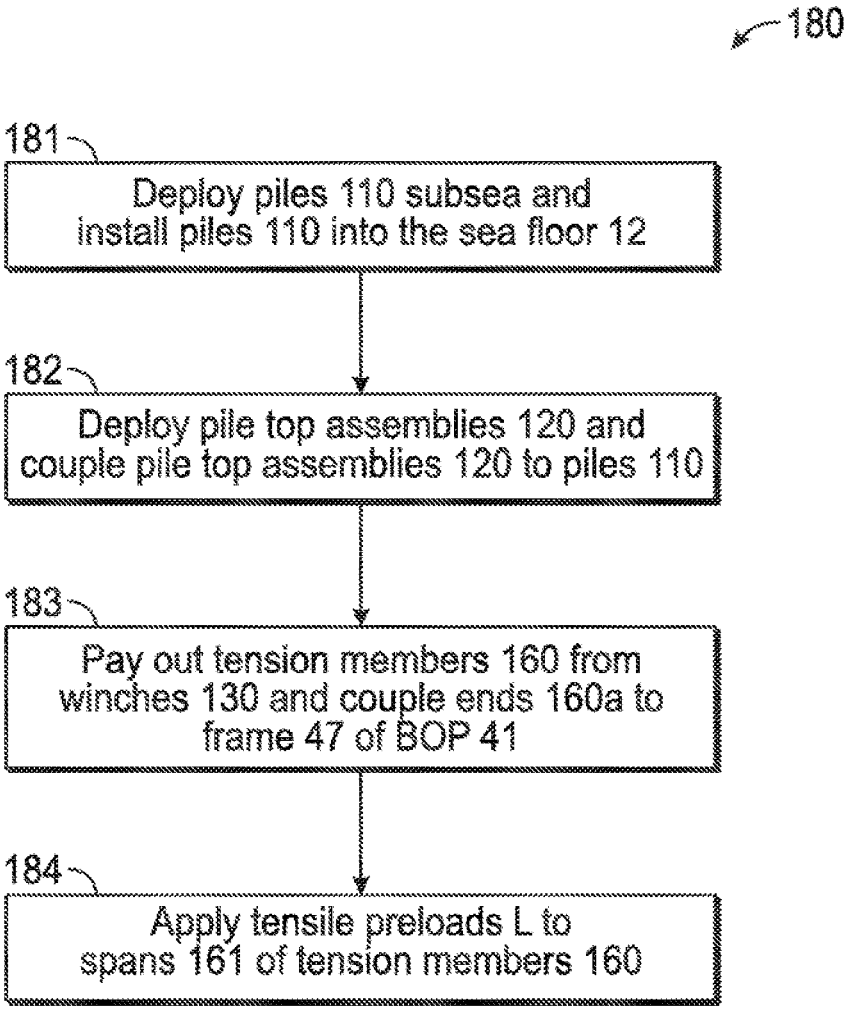
FIG. 14 is a graphical illustration of an embodiment of a method in accordance with the principles described herein for deploying and installing the tethering system of FIG. 1.

Referring now to FIG. 14, an embodiment of a method 180 for deploying and installing tethering system 100 is shown. For subsea deployment and installation of tethering system 100, one or more remote operated vehicles (ROVs) are preferably employed to aid in monitoring and positioning piles 110, coupling pile top assemblies 120 to upper ends

110*a* of piles 110, coupling tension members 160 to winches 140 and frame 47 of BOP 41, and operating subsea hardware (e.g., winches 140, locking mechanisms 150, locking rams 130, actuation system 154, etc.). Each ROV preferably includes an arm with a claw for manipulating objects and a subsea camera for viewing the subsea operations. Streaming video and/or images from the cameras are communicated to the surface or other remote location for viewing on a live or periodic basis.

Referring still to FIG. 14, in block 181, piles 110 are deployed subsea and installed subsea. In particular, piles 110 are lowered subsea from a surface vessel such as vessel 30 or a separate construction vessel. In general, piles 110 can be lowered subsea by any suitable means such as wireline. Next, piles 110 are installed (i.e., secured to the sea floor 12). To install piles 110, each pile 110 is vertically oriented and positioned immediately above the desired installation location in the sea floor 12 (i.e., at the desired circumferential position about wellhead 50 and at the desired radial distance $R_{110}$). Then, each pile 110 is advanced into the sea floor 12 (driven or via suction depending on the type of pile 110) until upper end 110*a* is disposed at the desired height above the sea floor 12. In general, piles 110 can be installed one at a time, or two or more at the same time.

Moving now to block 182, pile top assemblies 120 are deployed subsea and coupled to upper ends 110*a* of piles 110. In particular, assemblies 120 are lowered subsea from a surface vessel such as vessel 30 or a separate construction vessel. In general, assemblies 120 can be lowered subsea by any suitable means such as wireline. Next, assemblies 120 are lowered onto to ends 110*a* of piles 110 and locked thereon as previously described. Assemblies 120 are preferably mounted to piles 110 with each guide 125 aligned with the corresponding fairlead assembly 170. In general, assemblies 120 can be installed one at a time, or two or more at the same time.

Next, in block 182, locking mechanisms 150 are transitioned to the unlocked positions and tension members 160 are paid out from winches 140. In addition, ends 160*a* are coupled to frame 47 of BOP 41 via fairlead assemblies 170. In general, fairlead assemblies 170 can be deployed and installed at any time prior to block 183.

Moving now to block 184, tensile preloads L are applied to tension members 160 as previously described. Namely, the tensile preload L is applied to each tension member 160 by locking mechanism 150, and then rotating spool 141 with an ROV operated torque tool engaging interface 148 to pay in tension member 160. The tension member 160 and/or tension measured with the corresponding load pin 173 is monitored until the desired tensile preload L is applied (i.e., the slack, curve, and catenary in tensioned span 161 of tension member 160 are removed). Once the desired tensile preload L is achieved, locking mechanism 150 is transitioned to and maintained in the locked position.

It should be appreciated that tethering system 100 can be deployed and installed on an existing frame 47 of BOP 41. Thus, system 100 provides an option for reinforcing existing stacks (e.g., BOP 41) before, during, or after drilling operations, completion operations, production operations, or workover operations. Moreover, because pile top assemblies 120 are releasable coupled to piles 110, assemblies 120 and winches 140 mounted thereto can be retrieved and reused at different locations.

In the manner described, tethering system 100 is deployed and installed. Once installed and tensile preloads L are applied, tethering system 100 reinforces and/or stabilizes BOP 41, wellhead 50 and conductor 51 by restricting the lateral/radial movement of BOP 41. As a result, embodiments of tethering system 100 described herein offer the potential to reduce the stresses induced in BOP 41, tree 40, wellhead 50 and primary conductor 51, improve the strength and fatigue resistance of BOP 41, tree 40, wellhead 50 and primary conductor 51, and improve the bending moment response along primary conductor 51 below the sea floor 12.

Figure 15:
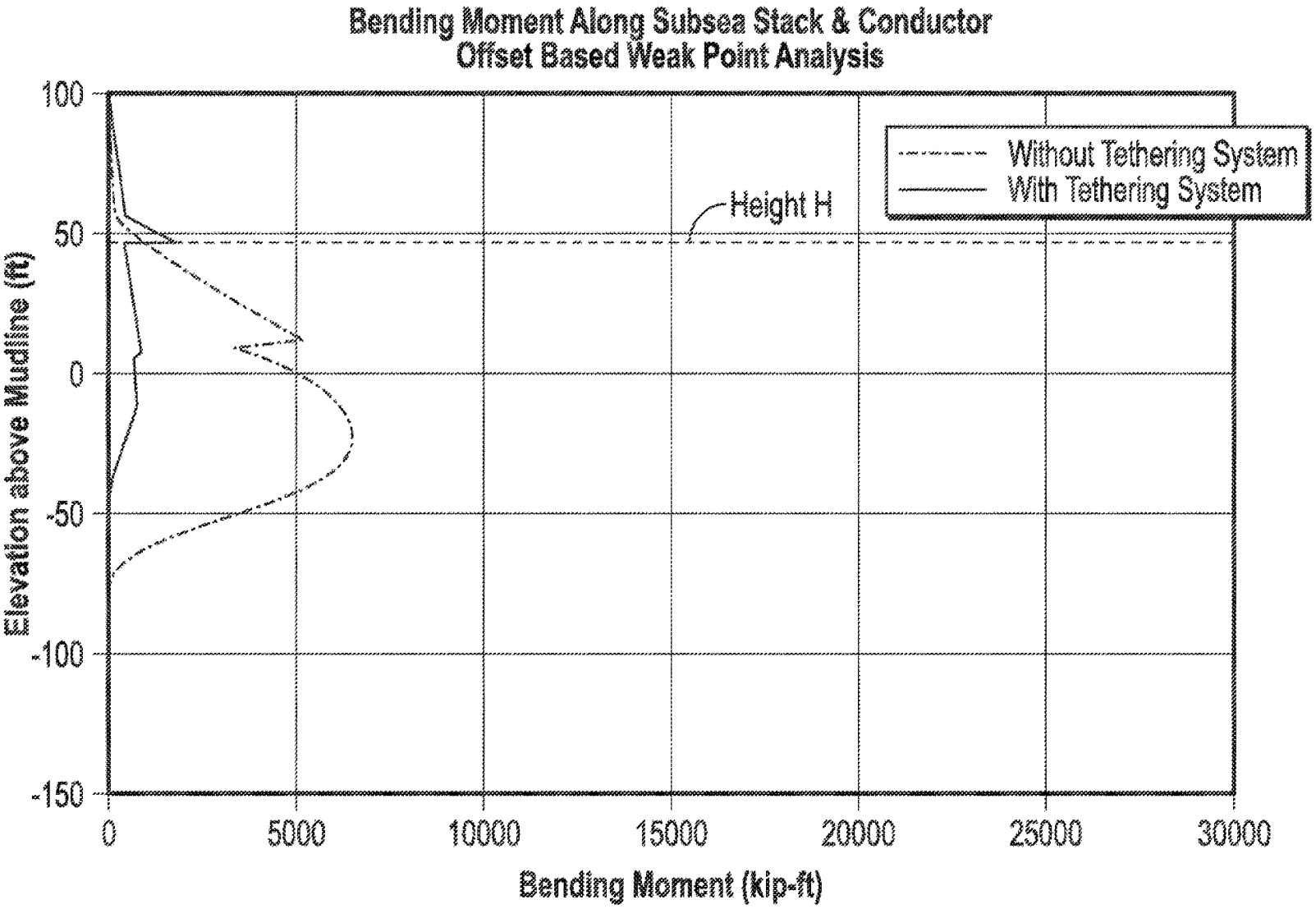
FIG. 15 is a graphical illustration comparing the bending moments induced along the subsea LMRP, BOP, wellhead and primary conductor of FIG. 1 due to a static offset of the surface vessel with and without the tethering system of FIG. 1.
Figure 16:
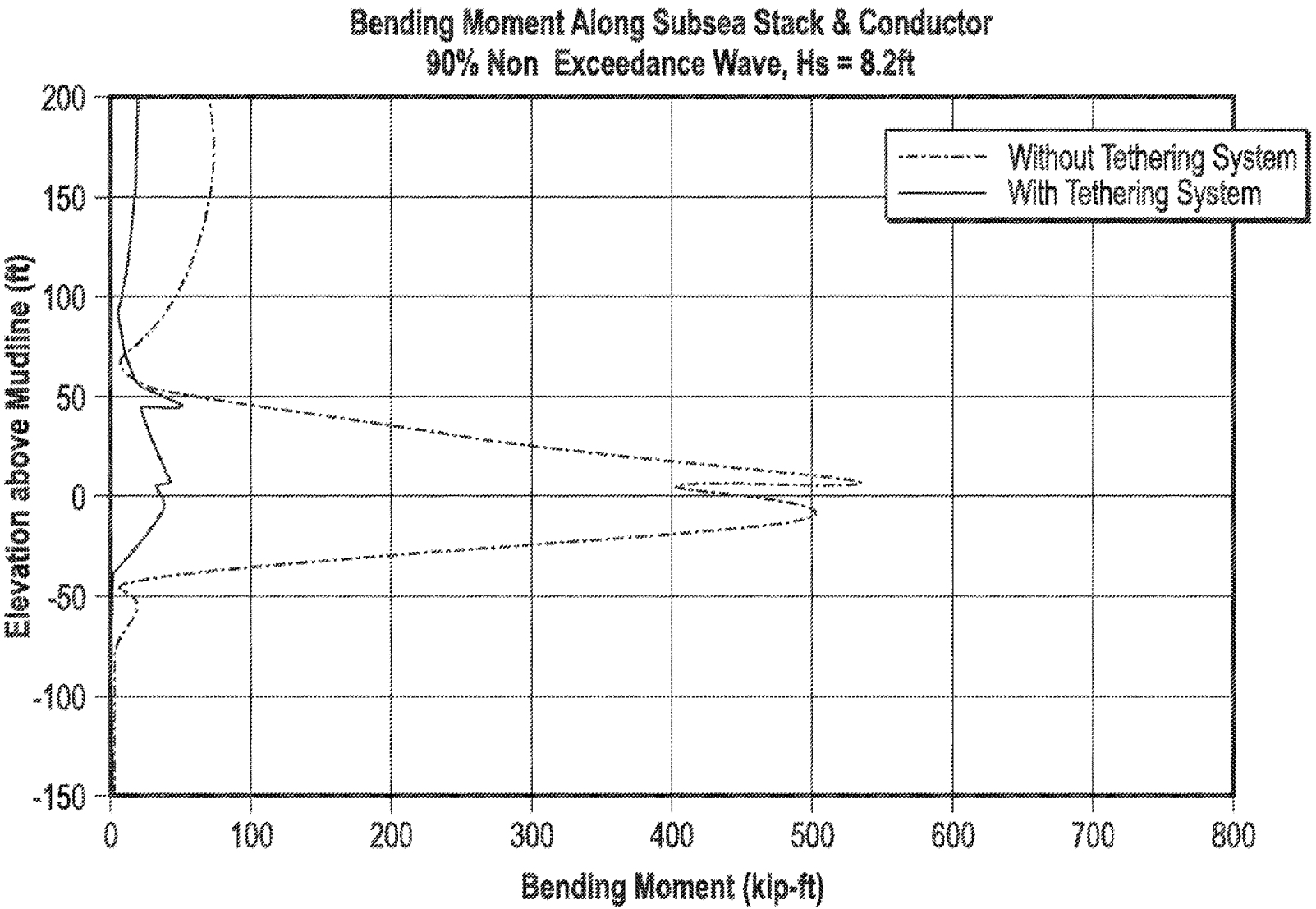
FIG. 16 is a graphical illustration comparing the bending moments induced along the subsea LMRP, BOP, wellhead and primary conductor of FIG. 1 due to a wave with and without the tethering system of FIG. 1.
Figure 17:
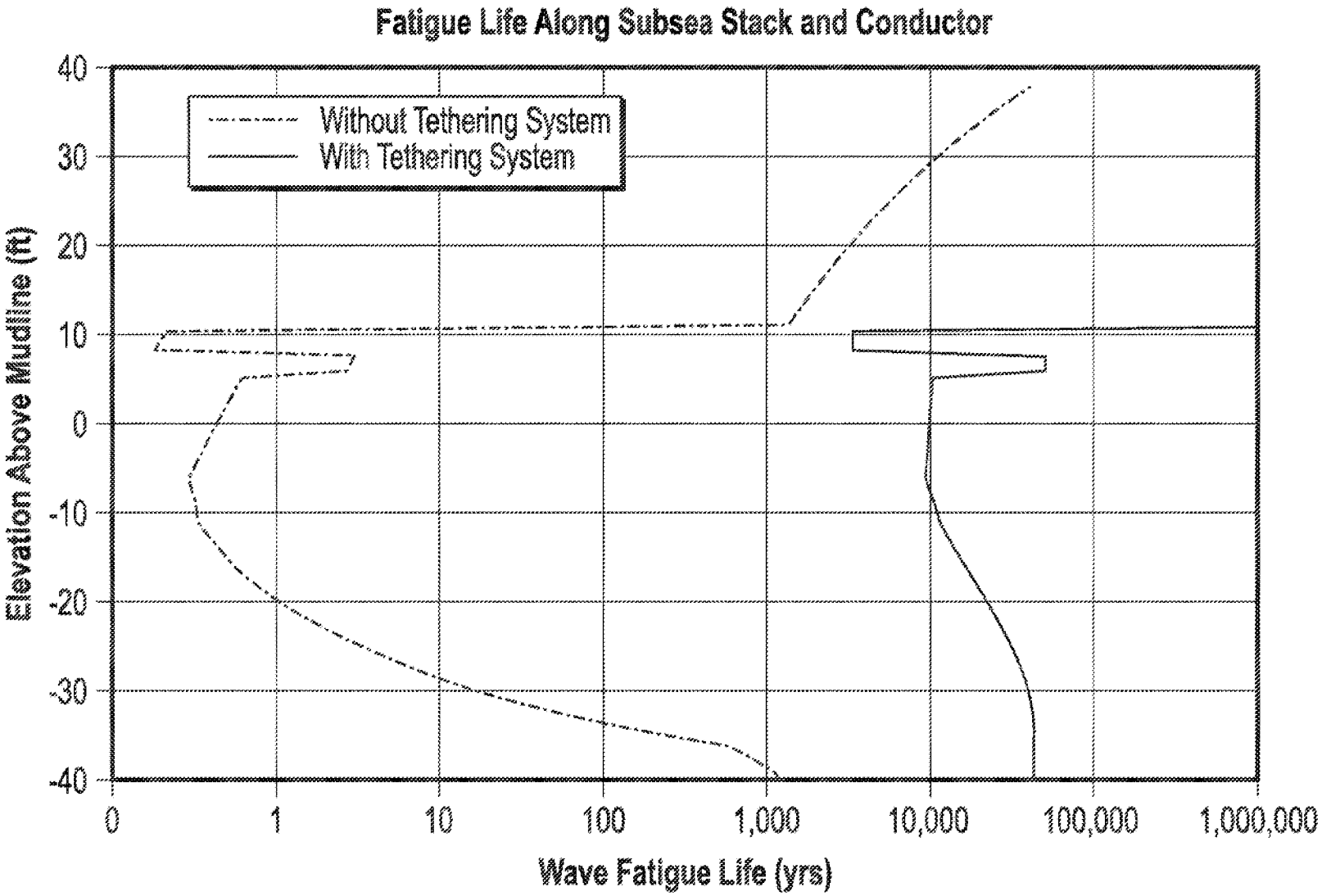
FIG. 17 is a graphical illustration comparing the fatigue life induced along the subsea LMRP, BOP, wellhead and primary conductor of FIG. 1 with and without the tethering system of FIG. 1.

Referring now to FIGS. 15-17, system 10, and in particular, primary conductor 51, wellhead 50, BOP 41, and LMRP 42 were modeled, and simulations were run with and without tethering system 100 to assess the impact of tethering system 100. FIGS. 15-17 graphically illustrate the results of those simulations with and without tethering system 100. In FIG. 15, the bending moments induced along LMRP 42, BOP 41, wellhead 50, and conductor 51 due to a static offset of surface vessel 30 are shown as a function of the elevation relative to the sea floor 12 (i.e., mudline); in FIG. 16, the bending moments induced along LMRP 42, BOP 41, wellhead 50, and conductor 51 due to a wave are shown as a function of the elevation relative to the sea floor 12 (i.e., mudline); and in FIG. 17, the fatigue life along LMRP 42, BOP 41, wellhead 50, and conductor 51 is shown as a function of the elevation relative to the sea floor 12 (i.e., mudline).

Figure 18:
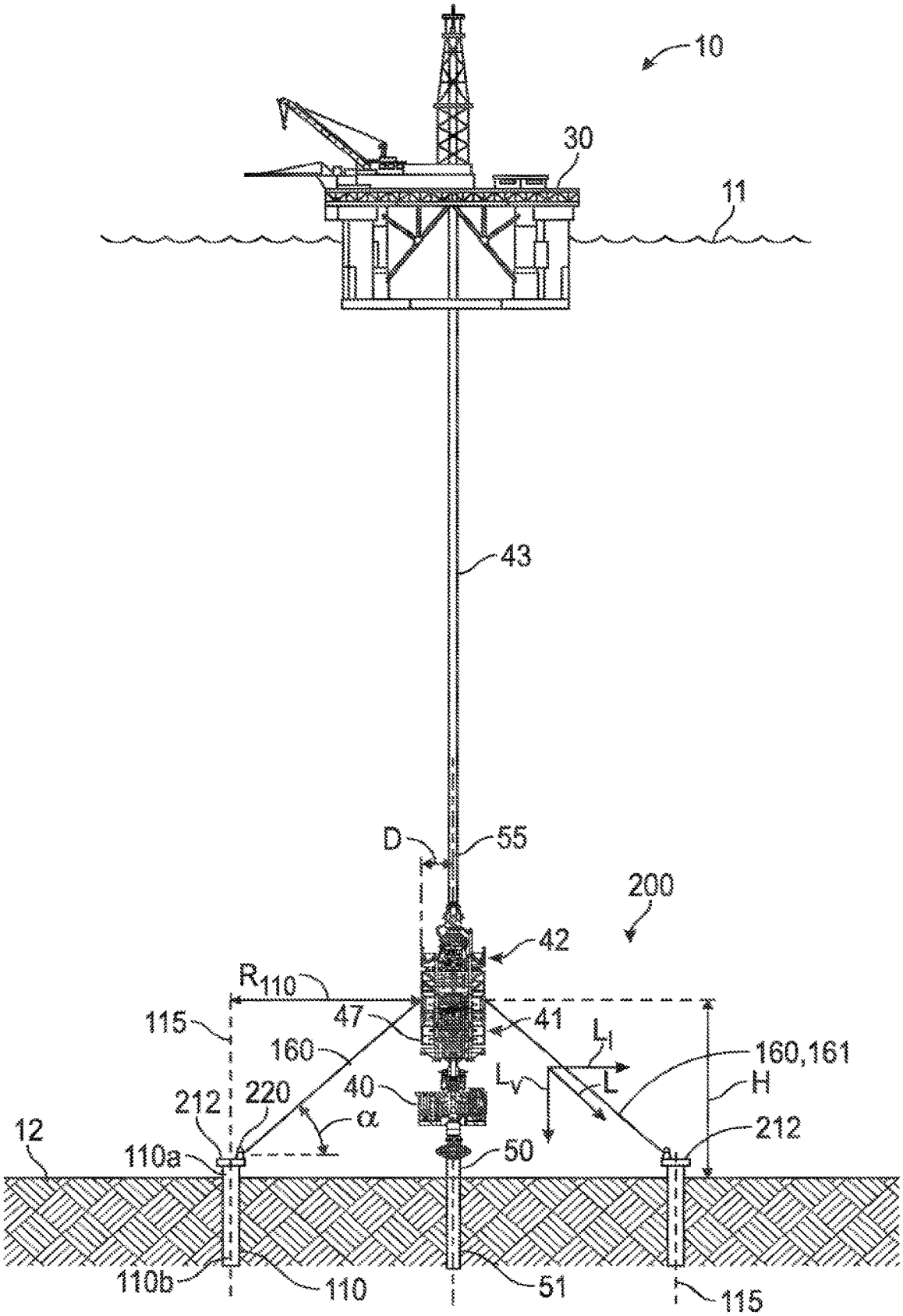
FIG. 18 is a schematic partial cross-sectional side view of an offshore system for completing a subsea well including an embodiment of a subsea tethering system in accordance with the principles described herein.
Figure 19:
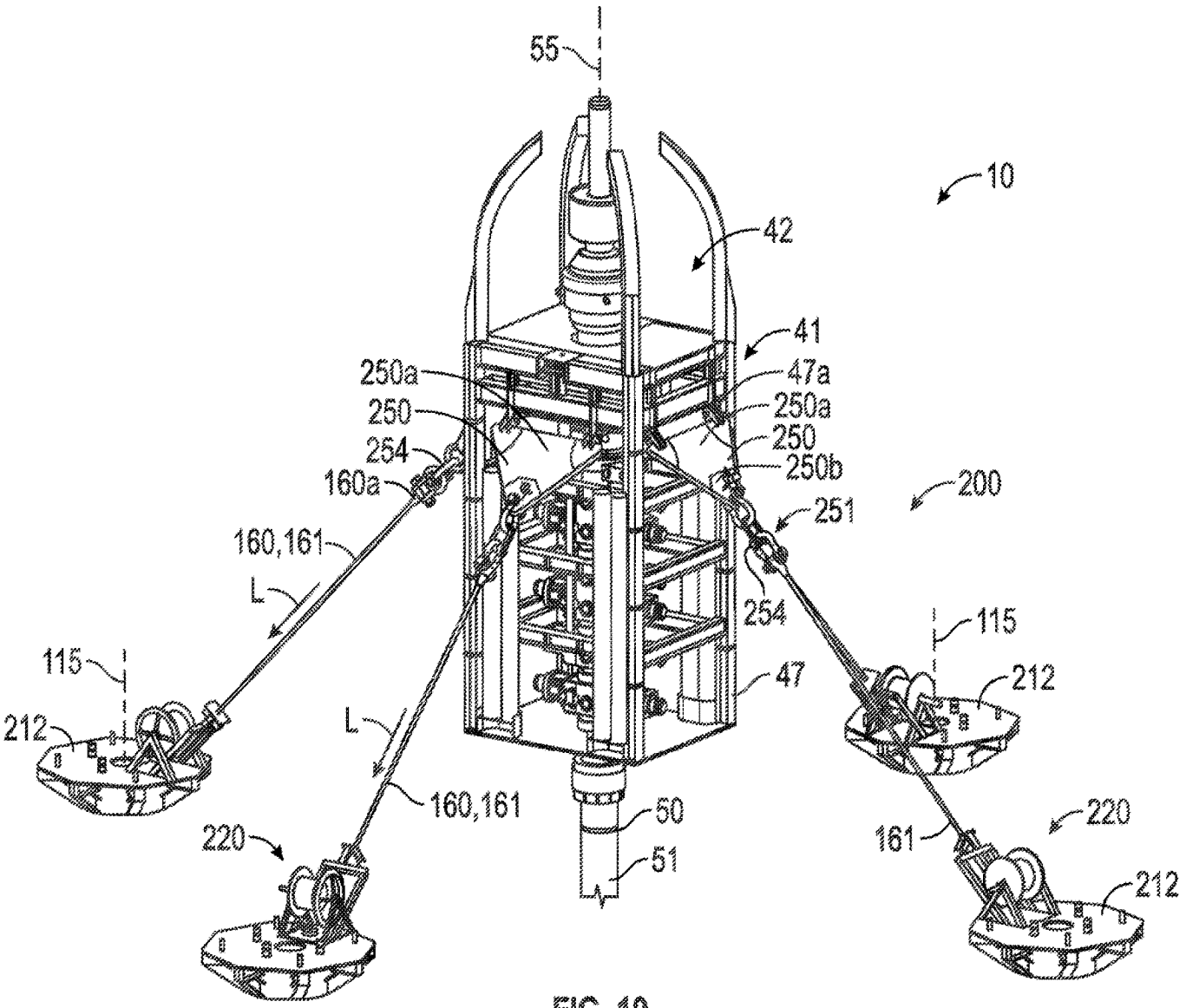
FIG. 19 is an enlarged isometric view of the offshore system of FIG. 20 illustrating the tethering system.

Referring now to FIGS. 18 and 19, another embodiment of a tethering system 200 for reinforcing BOP 41, wellhead 50, and primary conductor 51 of system 10 is shown. Similar to tethering system 100 previously described, in this embodiment, tethering system 200 reinforces BOP 41, wellhead 50, and primary conductor 51 by resisting lateral loads and bending moments applied thereto. As a result, system 200 offers the potential to enhance the strength and fatigue resistance of BOP 41, wellhead 50, and conductor 51. In FIG. 18, system 10 is shown configured for completion operations, and thus, includes tree 40, however, in FIG. 19, system 10 is shown configured for drilling operations, and thus, tree 40 is not included.

Referring still to FIGS. 18 and 19, in this embodiment, tethering system 200 includes a plurality of anchors 110, a plurality of pile top assemblies 212 mounted to anchors 110, a plurality of tensioning systems 220 releasable coupled to pile top assemblies 212, and a plurality of flexible tension members 160. Anchors 110 and tension members 160 are each as previously described. In this embodiment, tensioning systems 220 are winches, and thus, may also be referred to as winches 220. However, in other embodiments, different devices for applying and maintaining tension on the flexible tension members (e.g., tension members 160) can be employed. One winch 220 is coupled to each anchor 110, and one tension member 160 is wound to each winch 220 such that each flexible tension member 160 can be paid in and paid out from the corresponding winch 220.

Distal end 160*a* of each tension member 160 is coupled to frame 47 of BOP 41, and tensioned span 161 of each tension member 160 extends from the corresponding winch 220 to end 160*a*. In addition, each distal end 160*a* is coupled to frame 47 of BOP 41 at a height H measured vertically from the sea floor 12 and at a lateral distance D measured radially and perpendicularly from central axis 55. In this embodiment, each height H is the same, and each lateral distance D is the same. As previously described, for most subsea applications, lateral distance D is preferably between 5.0 and 15.0 feet, and more preferably about 10.0 feet. However, it should be appreciated that lateral distance D may depend, at least in part, on the available connection points to the frame 47 of BOP 41.

Tensile preload L is provided on each tensioned span 161 of tension members 160 with the corresponding winch 220. With no external loads or moments applied to BOP 41, the actual tension in each span 161 is the same or substantially the same as the corresponding tensile preload L. However, as previously described, when external loads and/or bending moments are applied to BOP 41, the actual tension in each span 161 can be greater than or less than the corresponding tensile preload L.

Winches 220 are positioned proximal to the sea floor 12, and ends 160*a* are coupled to frame 47 of BOP 41 above winches 220. Thus, each span 161 is oriented at an acute angle $\alpha$ measured upward from horizontal. Since portions 161 are in tension and oriented at acute angles $\alpha$, the tensile preload L applied by each tension member 160 to frame 47 of BOP 41 includes an outwardly oriented horizontal or lateral preload $L_l$ and a downwardly oriented vertical preload $L_v$. Without being limited by this or any particular theory, the lateral preload $L_l$ and the vertical preload $L_v$ applied to BOP 41 by each tension member 160 are a function of the corresponding tensile load L and angle $\alpha$. For a given angle $\alpha$, the lateral preload $L_l$ and the vertical preload $L_v$ increase as the tensile load L increases, and decrease as the tensile load L decreases. For a given tensile load L, the lateral preload $L_l$ decreases and the vertical preload $L_v$ increases as angle $\alpha$ increases, and the lateral preload $L_l$ increases and the vertical preload $L_v$ decreases as angle $\alpha$ decreases. For example, at an angle $\alpha$ of 45°, the lateral preload $L_l$ and the vertical preload $L_v$ are substantially the same; at an angle $\alpha$ above 45°, the lateral preload $L_l$ is less than the vertical preload $L_v$; and at an angle $\alpha$ below 45°, the lateral preload $L_l$ is greater than the vertical preload $L_v$. In embodiments described herein, angle $\alpha$ of each span 161 is preferably between 10° and 60°, and more preferably between 30° and 45°.

The lateral preloads $L_l$ applied to frame 47 of BOP 41 resist external lateral loads and bending moments applied to BOP 41 (e.g., from subsea currents, riser 43, etc.). To reinforce and/or stabilize BOP 41, wellhead 50, and primary conductor 51 without interfering with an emergency disconnection of LMRP 42, each height H is preferably as high as possible but below LMRP 42, and may depend on the available connection points along frame 47 of BOP 41. In this embodiment, ends 160*a* are coupled to frame 47 at the upper end of BOP 41, just below LMRP 42. By tethering frame 47 of BOP 41 at this location, system 200 restricts and/or prevents BOP 41, tree 40, wellhead 50, and primary conductor 51 from moving and bending laterally, thereby stabilizing such components, while simultaneously allowing LMRP 42 to be disconnected from BOP 41 (e.g., via emergency disconnect package) without any interference by system 200.

Referring still to FIGS. 18 and 19, the tensile preload L in each tension member 160 is preferably as low as possible but sufficient to pull out any slack, curve, and catenary in the corresponding tension member 160. In other words, the tensile preload L in each tension member 160 is preferably the lowest tension that results in the corresponding span 161 extending linearly from the corresponding winch 220 to its end 160*a*. It should be appreciated that such tensile loads L in tension members 160 restrict and/or prevent the initial movement and flexing of BOP 41 at the onset of the application of an external loads and/or bending moments, while minimizing the tension in tension members 160 before and after the application of external loads and/or bending moments. The latter consequence minimizes the potential risk of damage to BOP 41, tree 40, and LMRP 42 in the event one or more tension members 160 uncontrollably break.

Figure 20:
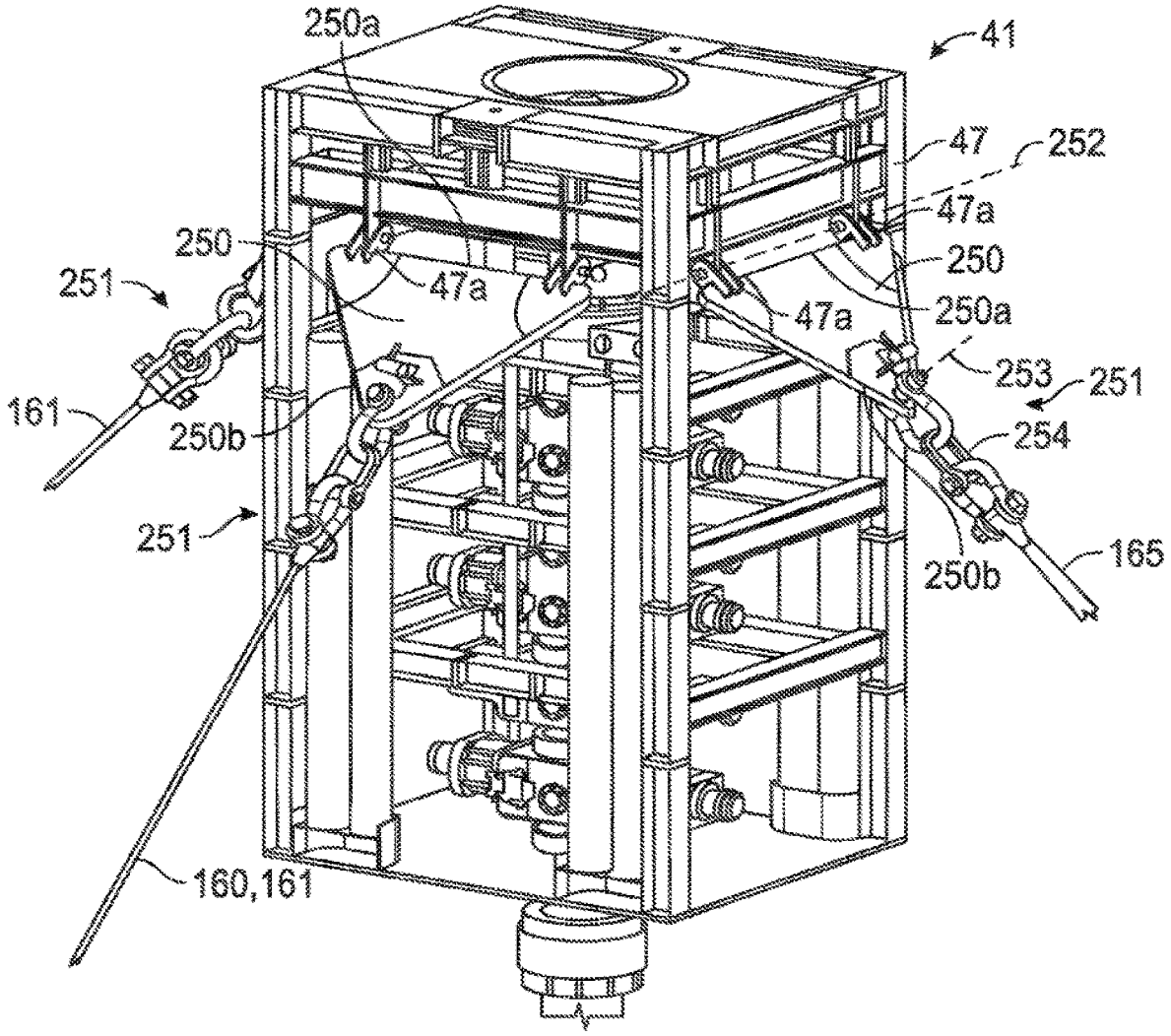
FIG. 20 is an enlarged isometric view of the subsea BOP of FIG. 18.

As best shown in FIGS. 19 and 20, in this embodiment, each end 160*a* is pivotally coupled to frame 47 of BOP 41 with an adapter plate 250. Each adapter plate 250 has a first or BOP end 250*a* pivotally coupled to frame 47 of BOP 41 at height H (from the sea floor 12) and lateral distance D (measured radially and perpendicular to axis 55), and a second or tension member end 250*b* coupled to end 160*a*. In particular, each end 250*a* is pivotally coupled to two pad eyes 47*a* disposed on the same side of frame 47 at height H and lateral distance D, and each end 250*b* is pivotally coupled to the corresponding end 160*a* with a shackle assembly 251. This arrangement allows each plate 250 and corresponding tension member 160 to pivot relative to frame 47 of BOP 41 about a horizontal axis 252, and allows each tension member 160 to pivot relative to the corresponding plate 250 about an axis 253 oriented perpendicular to (e.g., through the planar surface of) plate 250.

In this embodiment, each shackle assembly 251 includes a load cell 254 that continuously measures the tension in the corresponding tension member 160. The measured tensions are communicated to the surface in near real time (or on a period basis). In general, the measured tensions can be communicated by any means known in the art including, without limitation, wired communications and wireless communications (e.g., acoustic telemetry). By way of example, in this embodiment, the tensions measured by load cells 254 are communicated acoustically to the surface by a preexisting acoustic communication system housed on BOP 41. Communication of the measured tension in each tension member 160 to the surface enables operators and other personnel at the surface (or other remote location) to monitor the tensions, quantify the external loads on BOP 41, and identify any broken tension member(s) 240.

In the embodiment shown in FIGS. 19 and 20, ends 160*a* of tension members 160 are pivotally coupled to frame 47 of BOP 41 with adapter plates 250. However, in general, the tension members (e.g., tension members 160) can be coupled to the stack by other suitable means. For example, in other embodiments, plates 250 are eliminated, and the distal ends of the tension members (e.g., ends 160*a*) are directly coupled to the frame 47 (e.g., coupled to pad eyes 127*a* with shackle assemblies 251). Regardless of the means for coupling the tension members to the frame, a load cell (e.g., load cell 254) is preferably provided for each tension member to measure the tension in the corresponding tension member, which is communicated to the surface.

Referring again to FIGS. 18 and 19, in this embodiment, four anchors 110 are uniformly circumferentially-spaced about wellhead 50. However, in general, three or more uniformly circumferentially-spaced anchors 110 are preferably provided. The circumferential positions of anchors 110 are selected to avoid unduly interfering with (a) existing or planned subsea architecture; (b) subsea operations (e.g., drilling, completion, production, workover and intervention operations); (c) wellhead 50, primary conductor 51, tree 40, BOP 41, and LMRP 42; (d) subsea remotely operated vehicle (ROV) operations and access to tree 40, BOP 41, and LMRP 42; and (e) neighboring wells. In addition, each anchor 110 is disposed at a distance $R_{110}$ measured radially (center-to-center) from wellhead 50. Angles $\alpha$ are a function of distances $R_{110}$ and heights H. Thus, by varying distances $R_{110}$ and heights H, angles $\alpha$ can be adjusted as desired. However, if each height H is predetermined (e.g., ends 160*a* are coupled to frame 47 of BOP 41 at the same predetermined location such as the upper end of frame 47 of BOP 41 below LMRP 42), angles α are effectively a function of distances $R_{110}$. Thus, in embodiments where each height H is predetermined or known, radial distances $R_{110}$ are generally selected to achieve the preferred angles α without unduly interfering with (a) existing or planned subsea architecture; (b) subsea operations (e.g., drilling, completion, production, workover and intervention operations); (c) wellhead 50, primary conductor 51, tree 40, BOP 41, and LMRP 42; (d) subsea remotely operated vehicle (ROV) operations and access to tree 40, BOP 41, and LMRP 42; and (e) neighboring wells. To balance and uniformly distribute lateral preloads $L_l$, while maintaining preferred angles α with ends 160*a* coupled to frame 47 of BOP 41 at the preferred height H, in this embodiment, each radial distance $R_{110}$ is the same. Thus, in this embodiment, each tension preload L is the same, each height H is the same, each angle α is the same, and each distance $R_{110}$ is the same. However, in other embodiments, one or more preload L can be different and/or varied, one or more height H can be different and/or varied, one or more angle α can be different and/or varied, one or more radial distance $R_{110}$ can be different and/or varied, or combinations thereof.

Figure 21:
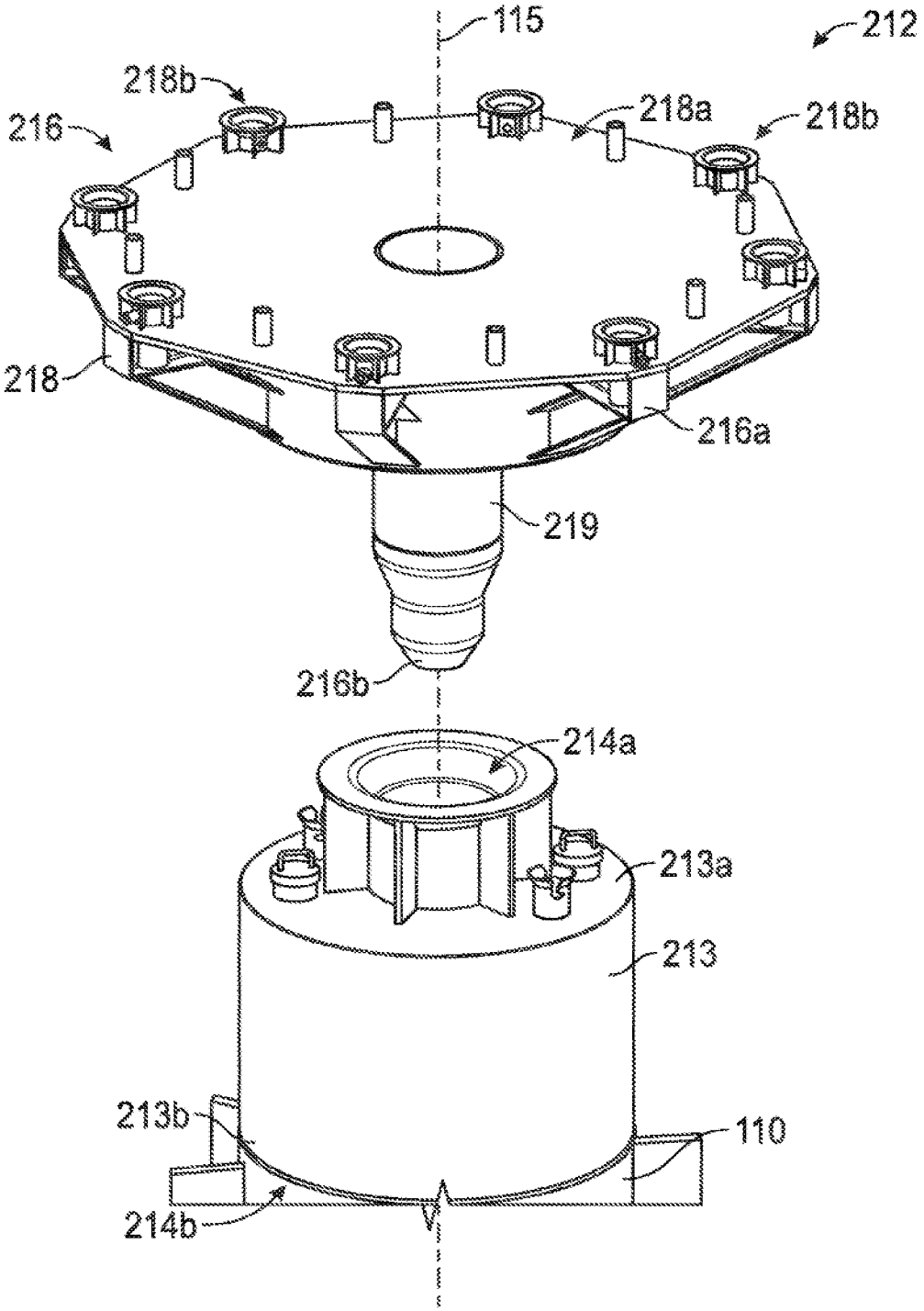
FIG. 21 is an enlarged exploded isometric view of one pile top assembly of FIG. 18.

Referring now to FIGS. 18, 19, and 21, axis 115 of each anchor 110 is vertically oriented, upper end 110*a* disposed above the sea floor 12, and lower end 110*b* disposed in the seabed below the sea floor 12. Piles 110 are sized to penetrate the sea floor 12 to a depth to sufficiently resist the anticipated tensile preloads L, as well as the loads and bending moments applied to BOP 41 without moving laterally or vertically relative to the sea floor 12.

One pile top assembly 212 is mounted to upper end 110*a* of each pile 110. As best shown in FIG. 21, each pile top assembly 212 includes a cap 213 fixably secured to the upper end 110*a* of pile 110 and an anchor adapter 216 releasable coupled to cap 213. Cap 213 and adapter 216 are coaxially aligned with axis 115. Cap 213 has a first or upper end 213*a* including a receptacle 214*a* and a second or lower end 213*b* including a receptacle 214*b*. The upper end 110*a* of pile 110 is seated in receptacle 214*b* and fixably secured to cap 213.

Referring still to FIGS. 19 and 21, adapter 216 has a first or upper end 216*a* and a second or lower end 216*b*. In addition, adapter 216 includes a generally annular connection body 218 at upper end 216*a* and an elongate pin or stabbing member 219 extending axially from body 218 to end 216*b*. Pin 219 is received by receptacle 214*a* and releasable locked therein, thereby releasable connecting adapter 216 to cap 213 and pile 110. In general, any locking mechanism known in the art can be employed to releasable lock pin 219 in the mating receptacle 214*a*.

Connection body 218 has a planar upward facing surface 218*a* and a plurality of uniformly circumferentially-spaced receptacles 218*b* disposed proximal the perimeter of surface 218*a* and extending downward from surface 218*a*. Each receptacle 218*b* is sized and configured to receive a mating pin or stabbing member 225 provided on each winch 220. By including multiple receptacles 218*b* in body 218, the position of one or more winches 220 coupled thereto can be varied as desired. With pin 225 of the winch 220 sufficiently seated in the desired receptacle 218*b*, it is releasable locked therein. In general, any locking mechanism known in the art can be employed to releasable lock pin 225 of the winch 220 in a given receptacle 218*b*. In this embodiment, the locking mechanism prevents the winch 220 from moving axially relative to body 218, but allows the winch 220 to rotate about the central axis of the winch pin relative to body 218.

Since each winch 220 is releasable coupled to the corresponding adapter 216 via receptacle 218*b*, and each adapter 216 is releasable coupled to the corresponding cap 213 and pile 110 via receptacle 214*a*, winches 220 and adapters 216 can be retrieved to the surface, moved between different subsea piles 110, and reused. Although winches 220 are configured to stab into adapters 216, and adapters 216 are configured to stab into caps 213 in this embodiment, in other embodiments, the adapters (e.g., adapters 216) can stab into the winches (e.g., winches 220) and/or the cap (e.g., cap 213) can stab into the adapter.

As previously described, tensioning systems 220 are releasable coupled to anchors 210 in this embodiment. However, in other embodiments, the tensioning mechanisms (e.g., winches 220) are coupled to the frame of BOP (e.g., frame 47 of BOP 41) and an end of each tension member (e.g., end 160*a* of each tension member 160) is coupled to the anchor (e.g., anchor 110). The arrangement with tensioning systems 220 coupled to anchors 210 is generally preferred as it generally requires less interaction with BOP 41 and a lower likelihood of interference with the BOP 41 (including frame 47), other subsea equipment, and subsea operations.

Figure 22:
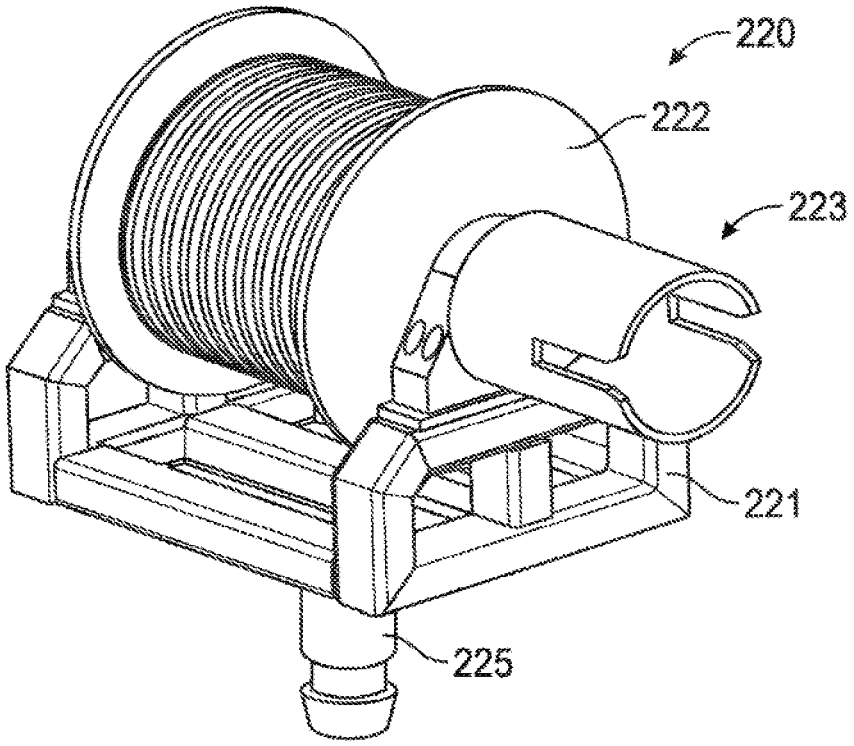
FIGS. 22 and 23 are isometric side views of one of the tensioning systems of FIG. 18.
Figure 23:
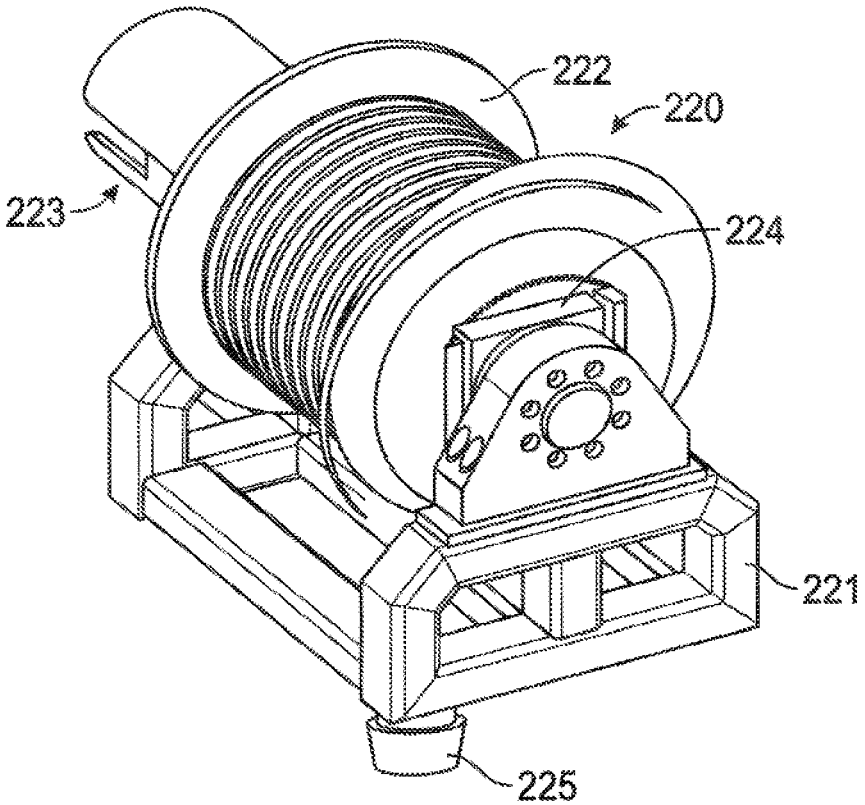

Referring now to FIGS. 22 and 23, one tensioning system 220 is shown, it being understood that each tensioning system 220 is the same. As previously described, in this embodiment, each tensioning system 220 is a winch. In particular, each tensioning system 220 includes a base 221, a spool 222 rotatably coupled to base 221, a torque tool interface 223 coupled to spool 222, and a locking mechanism or brake 224 coupled to spool 222 and base 221. A pin or stabbing member 225 of winch 220 removably received in receptacle 218*b* of adapter 216 is not shown in FIGS. 22 and 23, but generally extends downward from base 221. Spool 222 is rotated relative to base 221 to pay in and pay out tension member 160. Locking mechanism 224 releasable locks spool 222 relative to base 221. In particular, locking mechanism 224 has a "locked" position preventing spool 222 from rotating relative to base 221 and pile 110, and an "unlocked" position allowing spool 222 to rotate relative to base 221 and pile 110. In general, locking mechanism 224 can be any suitable locking mechanism known in the art or any locking mechanism described here (e.g., locking mechanism 150 previously described).

In this embodiment, the tensile preload L is applied to tension member 160 by unlocking mechanism 224, and then rotating spool 222 with an ROV operated torque tool engaging interface 223 to pay in tension member 160. The tension member 160 and/or tension measured with the corresponding load cell 254 can be monitored until the desired tensile preload L is applied (i.e., the slack, curve, and catenary in tension member 160 is removed). Once the desired tensile preload L is achieved, locking mechanism 224 is transitioned to and maintained in the locked position. Winch 220, and more specifically locking mechanism 224, has a sufficiently high holding capacity (e.g., on the order of hundreds of tons) to prevent the inadvertent pay out of tension member 160 when locking mechanism 224 is locked and external loads are applied to BOP 41.

Figure 24:
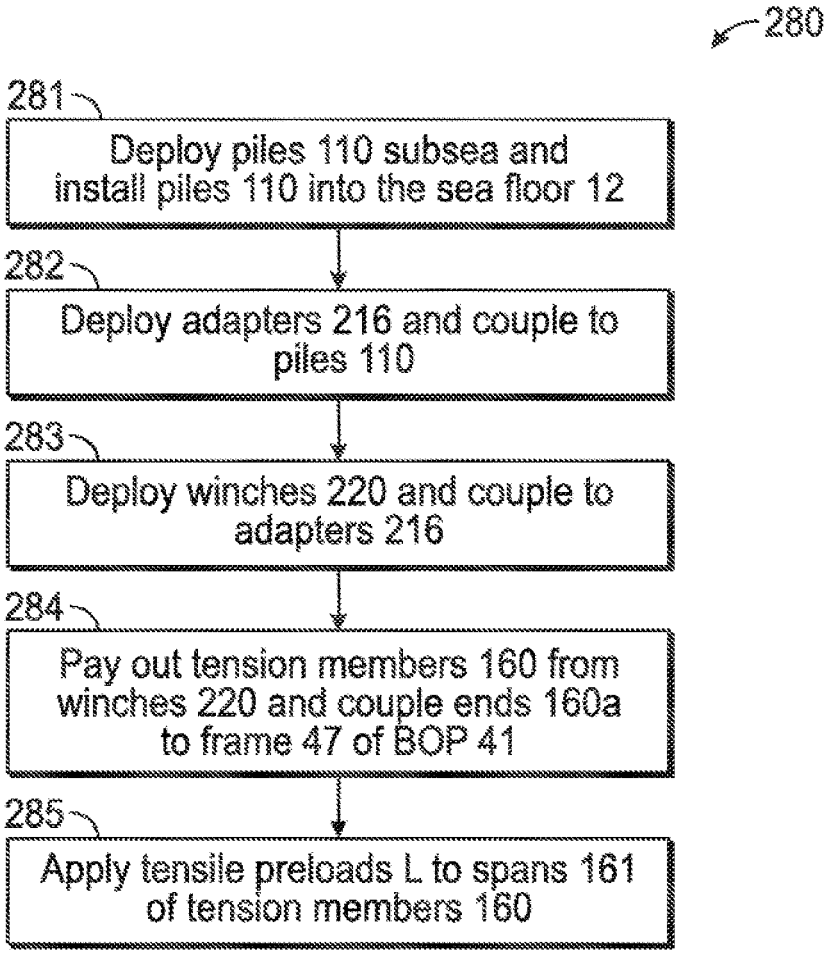
FIG. 24 is a graphical illustration of an embodiment of a method in accordance with the principles described herein for deploying and installing the tethering system of FIG. 18.

Referring now to FIG. 24, an embodiment of a method 280 for deploying and installing tethering system 200 is shown. For subsea deployment and installation of tethering system 200, one or more remote operated vehicles (ROVs) are preferably employed to aid in monitoring and positioning piles 110, coupling adapters 216 to caps 213 disposed at the upper ends of piles 110, coupling winches 220 to adapters 216, coupling tension members 160 to winches 220 and frame 47 of BOP 41, and operating winches 220. Each ROV preferably includes an arm with a claw for manipulating objects and a subsea camera for viewing the subsea operations. Streaming video and/or images from the cameras are communicated to the surface or other remote location for viewing on a live or periodic basis. In addition, each ROV is preferably configured to operate a subsea torque tool to apply the tensile preload L to tension members 160.

Referring still to FIG. 24, in block 281, piles 110 are deployed subsea with caps 213 mounted thereto. In particular, piles 110 are lowered subsea from a surface vessel such as vessel 30 or a separate construction vessel. In general, piles 110 can be lowered subsea by any suitable means such as wireline. Next, piles 110 are installed (i.e., secured to the sea floor 12). To install piles 110, each pile 110 is vertically oriented and positioned immediately above the desired installation location in the sea floor 12 (i.e., at the desired circumferential position about wellhead 50 and at the desired radial distance $R_{110}$). Then, each pile 110 is advanced into the sea floor 12 (driven or via suction depending on the type of pile 110) until cap 213 is disposed at the desired height above the sea floor 12. In general, piles 110 can be installed one at a time, or two or more at the same time.

Moving now to block 282, adapters 216 are deployed subsea and coupled to caps 213. In particular, adapters 216 are lowered subsea from a surface vessel such as vessel 30 or a separate construction vessel. In general, adapters 216 can be lowered subsea by any suitable means such as wireline. Next, adapters 216 are coupled to caps 213 and piles 110 by aligning each pin 219 with the corresponding receptacle 214*a*, lowering adapters 216 to seat pins 219 in receptacles 214, and then releasable locking pins 219 within receptacles 214, thereby forming anchors 210. In general, adapters 216 can be installed one at a time, or two or more at the same time.

With anchors 210 secured to the sea floor 12, winches 220 are deployed subsea and coupled to adapters 216 in block 283. In particular, winches 220 are lowered subsea from a surface vessel such as vessel 30 or a separate construction vessel. In general, winches 220 can be lowered subsea by any suitable means such as wireline. Winches 220 are preferably deployed subsea with tension members 160 coupled thereto. Next, winches 220 are coupled to adapters 216 by aligning the pin of each winch 220 with the corresponding receptacle 218*b*, lowering winches 220 to seat the winch pins in receptacles 218*b*, and then releasable locking the winch pins within receptacles 218*b*. In general, winches 220 can be installed one at a time, or two or more at the same time.

Next, in block 284, tension members 160 are paid out from winches 220 with locking mechanisms 224 in the unlocked positions, and ends 160*a* are coupled to frame 47 of BOP 41. In this embodiment, ends 160*a* are coupled to frame 47 of BOP 41, and in particular the upper end of BOP frame 47, via shackle assemblies 251 and plates 250 as previously described. In general, shackle assemblies 251 and plates 250 can be deployed and installed at any time prior to block 315.

Moving now to block 285, tensile preloads L are applied to tension members 160 as previously described. Namely, the tensile preload L is applied to tension member 160 by unlocking mechanism 224, and then rotating spool 222 with an ROV operated torque tool engaging interface 223 to pay in tension member 224. The tension member 160 and/or tension measured with the corresponding load cell 254 is monitored until the desired tensile preload L is applied (i.e., the slack, curve, and catenary in tensioned span 161 of tension member 160 is removed). Once the desired tensile preload L is achieved, locking mechanism 224 is transitioned to and maintained in the locked position.

It should be appreciated that tethering system 200 can be deployed and installed on an existing frame 47 of BOP 41. Thus, system 200 provides an option for reinforcing existing stacks (e.g., BOP 41) before, during, or after drilling operations, completion operations, production operations, or workover operations. Moreover, because adapters 216 are releasable coupled to piles 110, and winches 220 are releasable coupled to adapters 216, adapters 216 and/or winches 220 can be reused at different locations.

In the manner described, tethering system 200 is deployed and installed. Once installed and tensile preloads L are applied, tethering system 200 reinforces and/or stabilizes BOP 41, wellhead 50 and conductor 51 by restricting the lateral/radial movement of BOP 41. As a result, embodiments of tethering system 200 described herein offer the potential to reduce the stresses induced in BOP 41, tree 40, wellhead 50 and primary conductor 51, improve the strength and fatigue resistance of BOP 41, tree 40, wellhead 50 and primary conductor 51, and improve the bending moment response along primary conductor 51 below the sea floor 12.

Figure 25:
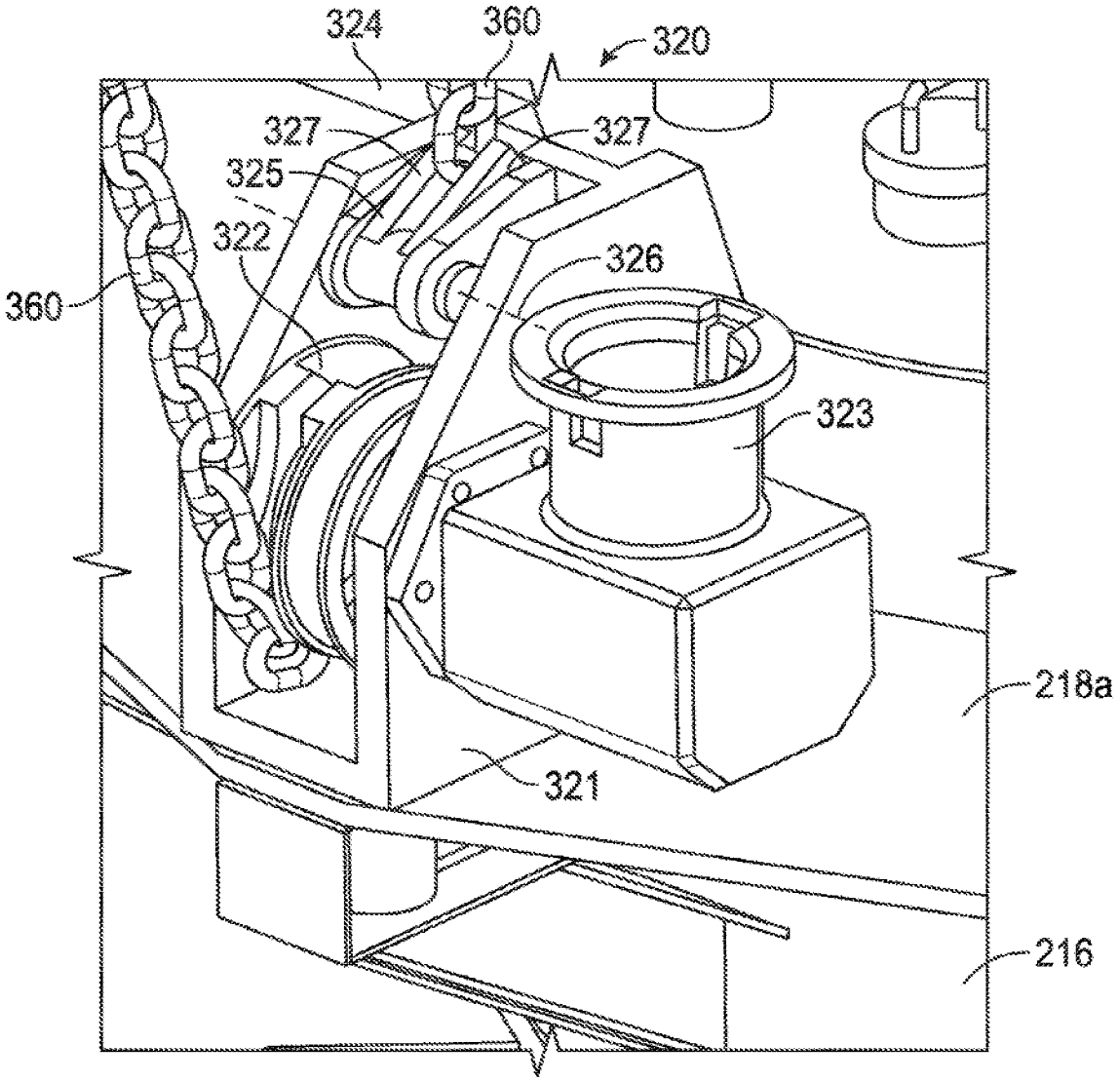
FIG. 25 is an enlarged view of an embodiment of a tensioning system that can be employed in the tethering system of FIG. 18.

In the embodiments of tethering systems 100, 200 previously described, tension members 160 can comprise Dyneema® rope, and winches 140, 220 include an ROV torque tool interface 148, 223, respectively, and locking mechanism 150, 224. However, in other embodiments, the tension members (e.g., tension members 160) can include different materials and/or different types of tensioning mechanisms (e.g., winches) can be utilized. For example, referring now to FIG. 25, an alternative tension member 360 and tensioning system 320 that can be used in system 200 in place of tension members 160 and tensioning systems 220, respectively, is shown. In this embodiment, tension member 360 comprises a chain, and tensioning system 320 is a winch configured to pay in and pay out the chain, as well as lock the chain. In particular, winch 320 includes a base 321, a chain wheel 322 rotatably coupled to base 321, an ROV torque tool interface 323 coupled to chain wheel 322, and a locking mechanism or brake 324 coupled to base 321. A pin or stabbing member extends downward from base 321 and is locked within mating receptacle 218*b* of adapter 216 as previously described. Chain wheel 322 is rotated relative to base 321 to pay in and pay out chain 360.

Locking mechanism 324 controls the pay out of chain 360. In this embodiment, locking mechanism 324 includes a locking member or chock 325 pivotally coupled to base 321. Chock 325 pivots about a horizontal axis 326 and includes a pair of parallel arms 327 that are spaced apart a horizontal distance that is substantially the same or slightly greater than the minimum width of a link of chain 360. Thus, a first plurality of links of chain 360 generally lying in a plane parallel to arms 327 and perpendicular to axis 326 can pass between arms 327, however, a second plurality of links of chain 360 generally oriented perpendicular to the first plurality of links (i.e., lying in a plane oriented parallel to axis 326) cannot pass between arms 327. The first plurality of links and the second plurality of links of chain 360 are arranged in an alternating fashion. Therefore, every other link of chain 360 can pass between arms 327, whereas the links therebetween cannot pass between arms 327. Accordingly, when chock 325 is pivoted away from chain 360, chain 360 can be paid in or paid out from chain wheel 322, however, when chock 325 is pivoted into engagement with chain 360, one link of chain 360 (i.e., a link generally lying in a plane parallel to arms 327 and perpendicular to pivot axis 326) is slidingly disposed between arms 327, the adjacent link of chain 360 positioned above arms 327 is prevented from passing between arms 327, thereby preventing chain 360 from being paid out. Therefore, locking mechanism 324 and locking member 325 may be described as having a "locked" position with locking member 325 pivoted into engagement with chain 360 with one link of chain 360 disposed between arms 327, thereby preventing chain 360 from being paid out from chain wheel 322; and an "unlocked" position with locking member 325 pivoted away from chain 360, thereby allowing chain 360 to be paid in and paid out from wheel 322. In this embodiment, locking mechanism 324 and locking member 325 are biased to the locked position via gravity. However, in other embodiments, a biasing member such as a spring can be employed to bias locking mechanism 324 and locking member 325 to the locked position.

In this embodiment, the tensile preload L is applied to tension member 360 by locking mechanism 324 and locking member 325 to the unlocked position, and then rotating chain wheel 322 with an ROV operated torque tool engaging interface 323 to pay in tension member 360. The tension member 360 and/or the tension in tension member 360 (as measured with the corresponding load cell 254) can be monitored until the desired tensile preload L is applied (i.e., the slack, curve, and catenary in the tensioned span of tension member 360 are removed). Once the desired tensile preload L is achieved, locking mechanism 324 is transitioned to and maintained in the locked position. Winch 320, and more specifically locking mechanism 324, has a sufficiently high holding capacity (e.g., on the order of hundreds of tons) to prevent the inadvertent pay out of tension member 360 when locking mechanism 324 is locked and external loads are applied to BOP 41.

In general, the tensile preload L in each chain 360 is preferably as low as possible but sufficient to pull out any slack, curve, and catenary in the corresponding chain 360. In other words, the tensile preload in L in each chain 360 is preferably the lowest tension that results in that chain 360 extending linearly from the corresponding chain wheel 322 to its distal end coupled to BOP 41. It should be appreciated that such tensile loads L in chains 360 restrict and/or prevent the initial movement and flexing of BOP 41 at the onset of the application of an external loads and/or bending moments, while minimizing the tension in each chain 360 before and after the application of the external loads and/or bending moments. The latter consequence minimizes the potential risk of inadvertent damage to BOP 41, tree 40, and LMRP 42 in the event one or more chain 360 uncontrollably breaks.

Figure 26:
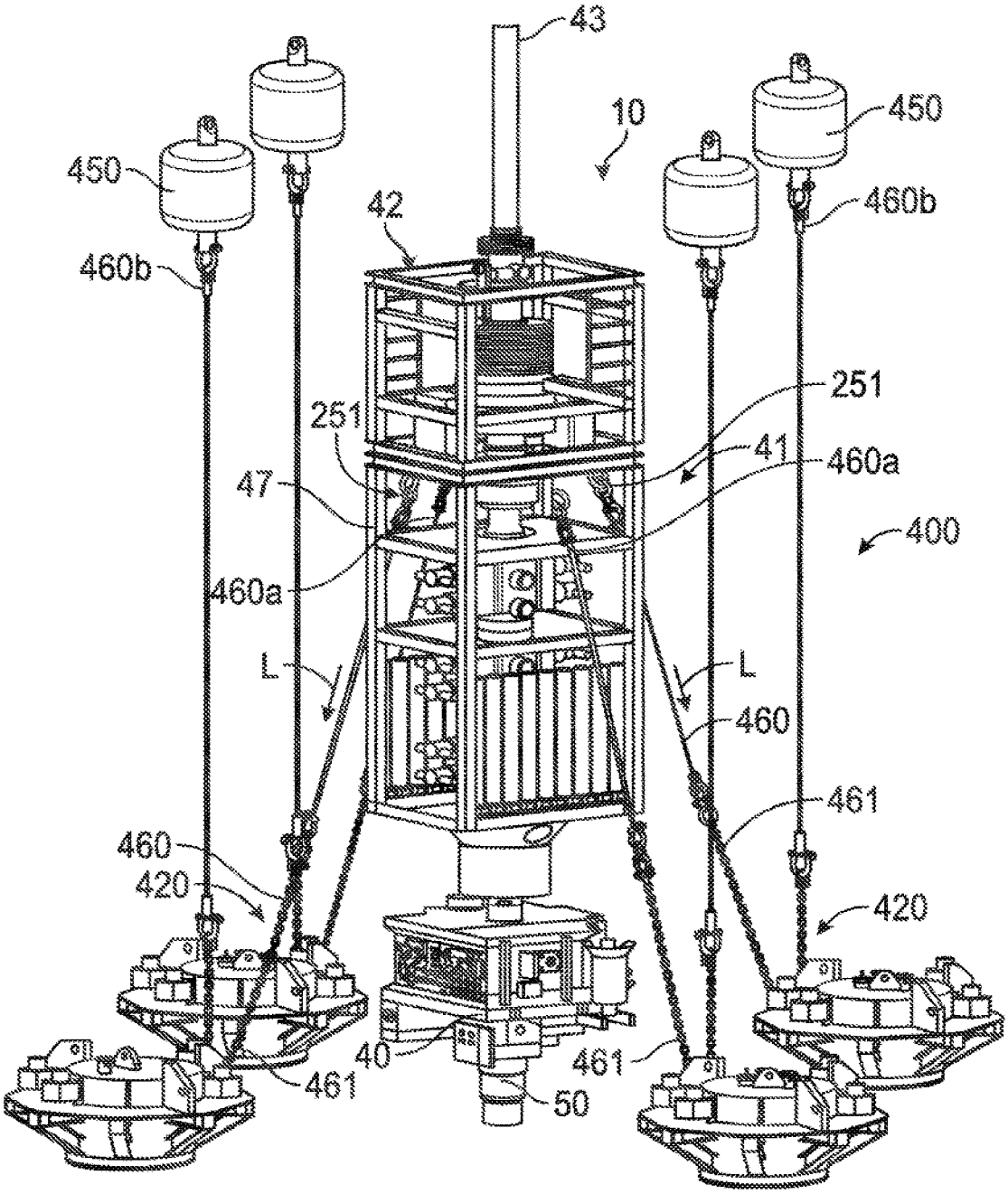
FIG. 26 is an enlarged isometric view of an offshore drilling system including an embodiment of a subsea tethering system in accordance with the principles described herein.
Figure 27:
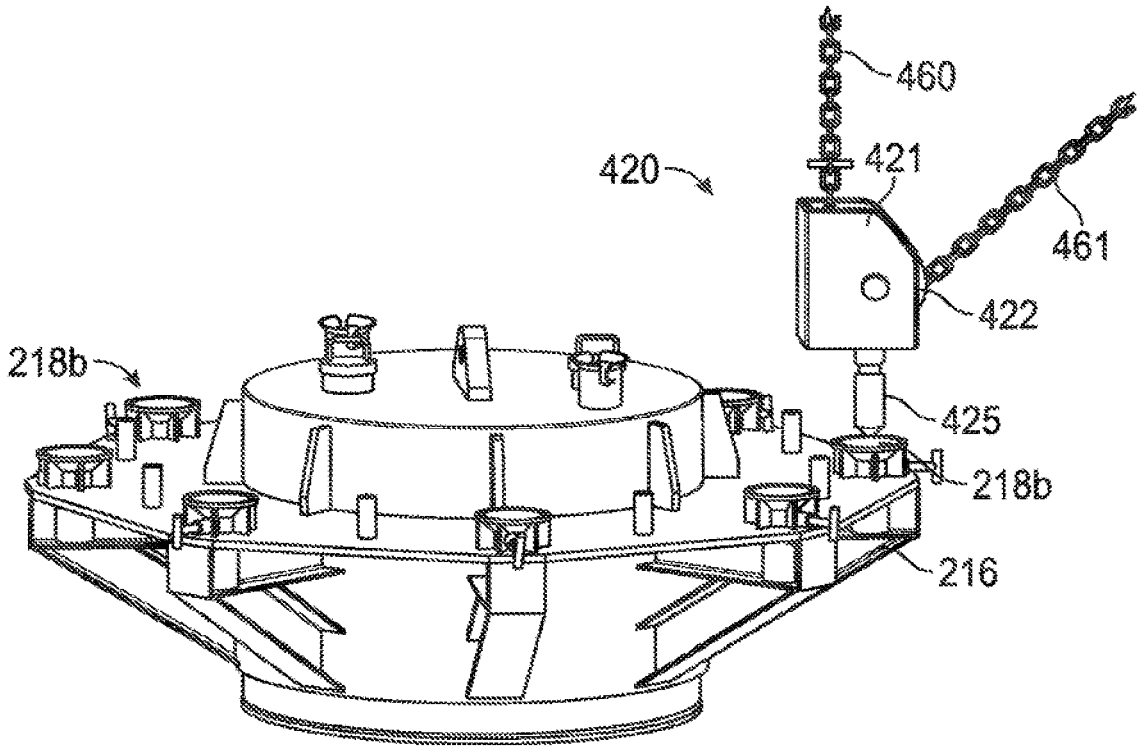
FIG. 27 is an enlarged, exploded isometric view of the upper end of one anchor and tensioning systems of the tethering system of FIG. 26.

In tethering systems 100, 200 previously described, the tensile preload L is applied to tension members 160 by rotating spool 141 and chain wheel 322, respectively, with an ROV torque tool. However, in other embodiments, alternative means are employed for inducing the tensile preload L in the tension members (e.g., tension members 160, 360). For example, referring now to FIG. 26, an embodiment of a tethering system 400 for tethering and reinforcing BOP 41, wellhead 50, and primary conductor 51 is shown. Tethering system 400 is substantially the same as tethering system 200 previously described except that tension members 160 are replaced with tension members 460 comprising chains 461, plates 250 are eliminated, tension members 460 are directly coupled to frame 47 with shackle assemblies 251, tensioning systems 220 are replaced with tensioning systems 420, and the tensile preload L is applied to each tension member 460 with a net buoyant subsea buoy 450. As best shown in FIG. 27, in this embodiment, tensioning systems 420 are chain sheaves. Each chain sheave 420 includes a base 421, a pulley or chain wheel 422 rotatably coupled to base 421, and a locking mechanism (not visible in FIG. 27) coupled to base 421. A pin or stabbing member 425 extends downward from base 421 and is releasable locked within a mating receptacle **218*b* of adapter 216. Although tension members 460 include chains 461 in this embodiment, in general, tension members 460** can include chains, wire rope, Dyneema® rope, or combinations thereof.

The locking mechanism of chain sheave 420 controls the pay out of tension member 460. In particular, the locking mechanism has a "locked" position preventing tension member 460 from being paid out from chain wheel 422, and an "unlocked" position allowing tension member 460 to be paid in and paid out from chain wheel 422. In general, the locking mechanism of each chain sheave 420 can be any suitable locking mechanism known in the art or any locking mechanism described here (e.g., locking mechanism 150, 324 previously described).

Referring again to FIGS. 26 and 27, each tension member 460 has a first or BOP end **460*a* coupled to frame 47 with a shackle assembly 251 and a second or buoy end 460*b* coupled to a subsea buoy 450. A portion of each tension member 460 between ends 460*a*, 460*b* includes chain 461 extending around the corresponding chain wheel 422. In this embodiment, the tensile preload L is applied to each tension member 460 by unlocking the corresponding locking mechanism and allowing the buoy 450 to pull upward on the tension member 460. In generally, buoys 450 can be configured to have the buoyancy necessary to induce the desired tensile preloads L. The tension member 460 and/or the tension in tension member 460 (as measured with the corresponding load cell 254) can be monitored until the desired tensile preload L is applied (i.e., the slack, curve, and catenary in tension member 460 is removed). Once the desired tensile preload L is achieved, the corresponding locking mechanism is transitioned to and maintained in the locked position. Chain sheave 420, and more specifically the locking mechanism, has a sufficiently high holding capacity (e.g., on the order of hundreds of tons) to prevent the inadvertent pay out of tension member 460 when the locking mechanism is locked and external loads are applied to BOP 41**.

Tethering system 400 is generally deployed and installed in the same manner as tethering system 200 previously described. Once tethering system 400 is installed and tensile preloads L are applied to tension members 460, system 400 stabilizes BOP 41, wellhead 50 and conductor 51 to restrict the lateral/radial movement of BOP 41. As a result, embodiments of tethering system 400 described herein offer the potential to reduce the stresses induced in BOP 41, tree 40, wellhead 50 and primary conductor 51, improve the strength and fatigue resistance of BOP 41, tree 40, wellhead 50 and primary conductor 51, and improve the bending moment response along primary conductor 51 below the sea floor 12.

In general, the tensile preload L in each tension member 460 is preferably as low as possible but sufficient to pull out any slack, curve, and catenary in the corresponding member 460. In other words, the tensile preload in L in each member 460 is preferably the lowest tension that results in that member 460 extending linearly from the corresponding chain wheel 422 to its distal end coupled to BOP 41. It should be appreciated that such tensile loads L in chains 360 restrict and/or prevent the initial movement and flexing of BOP 41 at the onset of the application of an external loads and/or bending moments, while minimizing the tension in each member 460 before and after the application of the external loads and/or bending moments. The latter consequence minimizes the potential risk of inadvertent damage to BOP 41, tree 40, and LMRP 42 in the event one or more member 460 uncontrollably breaks.

Figure 28:
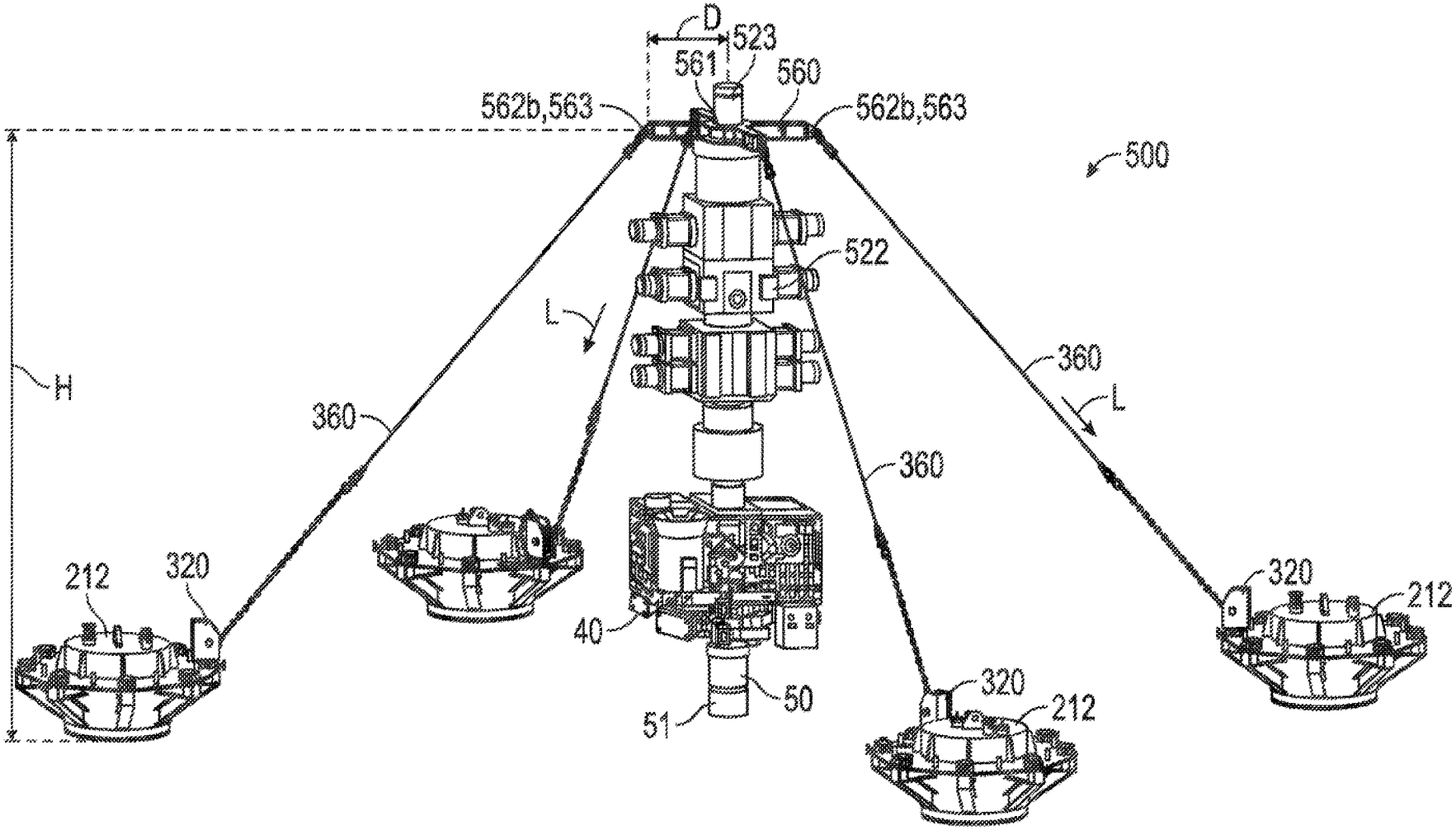
FIG. 28 is an enlarged isometric view of an offshore drilling system including an embodiment of a subsea tethering system in accordance with the principles described herein.

In the embodiments of tethering systems 100, 200, 400 previously described, the distal ends of tensioning members 160, 360, 460 are coupled to frame 47 of BOP 41. However, in some drilling and completion systems, the BOP does not include a frame. In such cases, alternative means are preferably provided for coupling to the subsea architecture at the highest elevation below the LMRP for the reasons previously described. For example, referring now to FIG. 28, an embodiment of a tethering system 500 for tethering and reinforcing a subsea BOP 522, wellhead 50, and primary conductor 51 (disposed below the sea floor 12) is shown. Wellhead 50 and primary conductor 51 are each as previously described, and BOP 522 is the same as BOP 41 previously described except that BOP 522 does not include frame 47.

Figure 29:
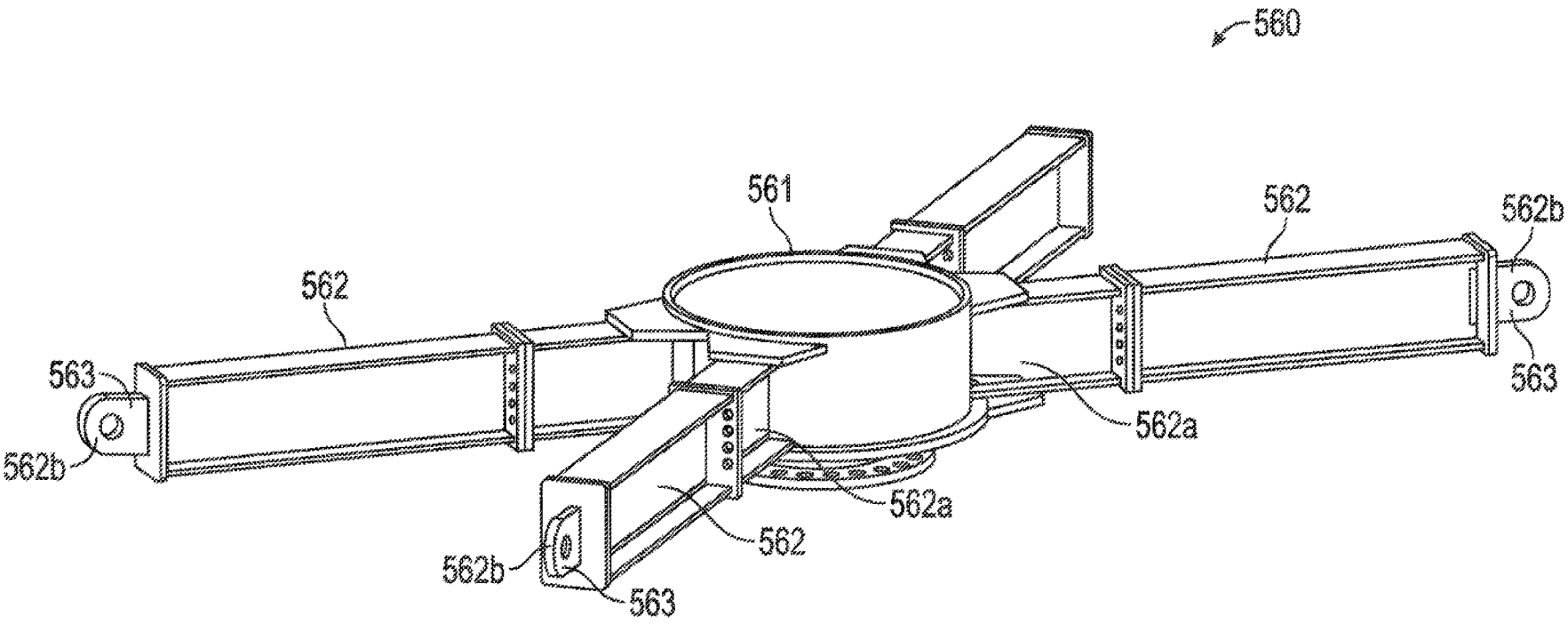
FIG. 29 is an isometric view of the spider support frame of FIG. 28.

In this embodiment, tethering system 500 includes anchors 110 (not visible in FIG. 28), pile top assemblies 212 mounted to anchors 110, tensioning systems 320, and tensioning members 360, each as previously described. However, since BOP 522 does not include a frame, tethering system 500 also includes an adapter 560 to couple tension members 360 to BOP 522. In particular, adapter 560 is mounted to BOP 522, and distal ends 360*a* of tension members 360 are coupled to adapter 560. As best shown in FIG. 29, in this embodiment, adapter 560 is a spider frame including a central annular hub 561 and a plurality of uniformly circumferentially-spaced rigid arms 562 extending radially outward from hub 561. Thus, each arm 562 has a first or radially inner end 562*a* attached to hub 561 and a second or radially outer end 562*b* distant from hub 561. Each end 562*b* comprises a pad eye 563 for coupling to end 360*a* of a corresponding tension member 360 with a shackle assembly 251 as previously described.

Referring again to FIG. 28, adapter 560 is mounted to BOP 522 by stabbing a mandrel 523 extending from the upper end of BOP 522 into hub 561. Subsequently, an LMRP (e.g., LMRP 42) is releasable connected to mandrel 523. Thus, adapter 560 is positioned between BOP 522 and the LMRP. With adapter 560 secured to BOP 522, ends 360*a* of tension members 360 are coupled to pad eyes 563 and the tensile preload L is applied to each tension member 360. Thus, in this embodiment, the locations of pad eyes 563 define the height H (from the sea floor 12) and the lateral distance D (measured radially and perpendicular from central axis 55). By varying the length of arms 562, the lateral distance D can be adjusted as desired. As previously described, for most subsea applications, lateral distance D is preferably between 5.0 and 15.0 feet, and more preferably about 10.0 feet.

Once tethering system 500 is installed and tensile preloads L are applied with tensioning systems 320. Accordingly, system 500 reinforces BOP 522, wellhead 50 and conductor 51 by restricting the lateral/radial movement of BOP 522. As a result, embodiments of tethering system 500 described herein offer the potential to reduce the stresses induced in BOP 522, tree 40, wellhead 50 and primary conductor 51, improve the strength and fatigue resistance of BOP 522, tree 40, wellhead 50 and primary conductor 51, and improve the bending moment response along primary conductor 51 below the sea floor 12.

In general, the tensile preload L in each member 360 is preferably as low as possible but sufficient to pull out any slack, curve, and catenary in the corresponding member 360. In other words, the tensile preload in L in each member 360 is preferably the lowest tension that results in that member 360 extending linearly from the corresponding chain wheel 322 to its distal end coupled to adapter 560. It should be appreciated that such tensile loads L in members 360 restrict and/or prevent the initial movement and flexing of BOP 41 at the onset of the application of an external loads and/or bending moments, while minimizing the tension in each member 360 before and after the application of the external loads and/or bending moments. The latter consequence minimizes the potential risk of inadvertent damage to BOP 41, tree 40, and LMRP 42 in the event one or more member 360 uncontrollably breaks.

In the manners described, embodiments of tethering systems 100, 200, 400, 500 described herein apply lateral preloads $L_l$ to subsea BOPs (e.g., BOP 41, 522). The lateral preloads $L_l$ applied to a given BOP are preferably substantially the same and uniformly distributed about the BOP and uniformly applied (i.e., the lateral preloads $L_l$ applied to a given BOP are preferably balanced). Accordingly, the lateral preloads $L_l$ generally seek to maintain the subsea architecture in a generally vertical orientation, reinforce the BOP (e.g., BOP 41, 522), the wellhead (e.g., wellhead 50), the tree (e.g., tree 40) (if provided), and the conductor (e.g., conductor 51) by restricting the lateral/radial movement of the BOP. As a result, embodiments of tethering systems 100, 200, 400, 500 described herein offer the potential to reduce the stresses induced in the BOP, the tree (if provided), the wellhead and the primary conductor, improve the strength and fatigue resistance of the BOP, the tree (if provided), the wellhead, and the primary conductor, and improve the bending moment response along the primary conductor below the sea floor 12.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for tethering a subsea blowout preventer (BOP), the system comprising:

an anchor disposed about the subsea BOP and secured to the sea floor; and a flexible tension member extending from a first end to a second end coupled to a tensioning system, wherein the flexible tension member extends horizontally and vertically from the first end to the second end to impart a lateral preload and a vertical preload to the subsea BOP;

wherein the tensioning system includes a winch configured to pay in and pay out the flexible tension member, the winch including a base, a spool rotatably coupled to the base, and a locking mechanism coupled to the spool and the base, the locking mechanism having a locked position preventing the spool from rotating relative to the base, and wherein the winch is coupled to a frame of the subsea BOP, and the first end of the flexible tension member is coupled to the anchor.

2. The system of claim 1 further comprising:

a torque tool interface configured for coupling to a remotely operated vehicle (ROV), wherein rotation of the torque tool interface causes rotation of the spool and paying in or out the flexible tension member.

3. The system of claim 2 wherein the winch comprises a receptacle for removably receiving and locking a stabbing member.

4. The system of claim 2 wherein the winch comprises a stabbing member extending from the base, the stabbing member being removably received and locked in a receptacle.

5. The system of claim 2 wherein the locking mechanism comprises a brake or a lock ring.

6. The system of claim 1 wherein the winch is releasable from a connection point on the subsea BOP.

7. The system of claim 6 wherein the winch comprises a stabbing member extending from the base, the stabbing member being removably received and locked in an adapter receptacle.

8. A method for tethering a subsea blowout preventer (BOP) coupled to a subsea wellhead to an anchor disposed about the subsea BOP and secured to the sea floor, the method comprising:

providing a flexible tension member extending from a first end to a second end coupled to a tensioning system, wherein the tensioning system includes a winch configured to pay in and pay out the flexible tension member, the winch including a base, a spool rotatably coupled to the base, and a locking mechanism coupled to the spool and the base, the locking mechanism having a locked position preventing the spool from rotating relative to the base;

coupling the first end of the flexible tension member to the anchor;

coupling the winch to a frame of the subsea BOP;

extending the flexible tension member horizontally and vertically from the first end to the second end;

imparting a lateral preload and a vertical preload to the subsea BOP; and moving the locking mechanism into the locked position.

9. The method of claim 8, wherein imparting the lateral preload and the vertical preload to the subsea BOP comprises:

coupling a remotely operated vehicle (ROV) to a torque tool interface; and rotating the spool via the torque tool interface to cause paying in or out the flexible tension member.

10. The method of claim 9 wherein the winch comprises a receptacle, the method further comprising:

receiving and locking a stabbing member in the receptacle.

11. The method of claim 9 wherein the winch comprises a stabbing member extending from the base, the method further comprising:

receiving and locking the stabbing member in a receptacle.

12. The method of claim 9 wherein the locking mechanism comprises a brake or a lock ring.

13. The method of claim 8 wherein the winch is releasable from a connection point on the subsea BOP.

14. The method of claim 13 wherein the winch comprises a stabbing member extending from the base, the method further comprising:

receiving and locking the stabbing member in an adapter receptacle.

15. The method of claim 14 further comprising removing the stabbing member from the adapter receptacle.

16. A system for tethering a subsea blowout preventer (BOP), the system comprising:

a plurality of anchors disposed about the subsea BOP and secured to the sea floor, wherein each anchor is a pile embedded in the seabed, each anchor having an upper end disposed above the sea floor and a lower end disposed in the seabed below the sea floor;

a plurality of tensioning systems, wherein each tensioning system is coupled to a frame of the BOP; and a plurality of flexible tension members, wherein each tension member is coupled to one of the anchors, wherein each tension member extends from a first end coupled to one of the tensioning systems to a second end coupled to an anchor; wherein each tensioning system is configured to apply a tensile preload to one of the tension members, and wherein each tensioning system is a winch configured to pay in and pay out the corresponding tension member.

17. The system of claim 16, wherein the second end of each tension member is directly coupled to one of the anchors.

18. The system of claim 16, further comprising a load cell coupled to each tension member and configured to measure the tension in the corresponding tension member.

19. The system of claim 16, wherein the plurality of anchors comprises at least three anchors, and wherein each anchor is a driven pile or a suction pile.

20. The system of claim 16, wherein each winch includes a spool rotatably coupled to a base coupled to the frame of the subsea BOP and a locking mechanism configured to prevent pay out of the corresponding tension member from the spool, wherein the spool has an axis of rotation.

21. The system of claim 20, wherein each locking mechanism includes a spool ring coupled to the spool, a hub fixably coupled to the frame of the subsea BOP, and a lock ring slidably mounted to the hub; wherein the spool ring includes a plurality of internal splines, the hub includes a plurality of external splines, and the lock ring includes a plurality of external splines and a plurality of internal splines; wherein the external splines of the hub mate and intermesh with the internal splines of the lock ring; wherein the internal splines of the spool ring are configured to mate and intermesh with the plurality of external splines of the lock ring; wherein the lock ring is configured to move axially along the hub between an unlocked position with the external splines of the lock ring axially spaced apart from the internal splines of the spool ring and a locked position with the external splines of the lock ring intermeshing with the internal splines of the spool ring.

22. The system of claim 16, wherein each tension member comprises a chain, or a wire rope.

* * * * *